US008074795B2

(12) United States Patent
Neu et al.

(10) Patent No.: US 8,074,795 B2
(45) Date of Patent: Dec. 13, 2011

(54) MULTIPLE SIZE STRAP AND TIE DOWN CONTAINER

(76) Inventors: Steven Neu, Clearwater, MN (US); Tammy Neu, Clearwater, MN (US)

( * ) Notice: Subject to any disclaimer, the term of this patent is extended or adjusted under 35 U.S.C. 154(b) by 0 days.

(21) Appl. No.: 12/351,411

(22) Filed: Jan. 9, 2009

(65) Prior Publication Data

US 2009/0188821 A1 Jul. 30, 2009

Related U.S. Application Data

(63) Continuation-in-part of application No. 11/418,732, filed on May 4, 2006, now abandoned.

(60) Provisional application No. 60/677,574, filed on May 4, 2005.

(51) Int. Cl.
*B65D 85/18* (2006.01)
*B65D 73/00* (2006.01)
*A45F 5/00* (2006.01)

(52) U.S. Cl. ..... 206/279; 206/290; 206/493; 294/159

(58) Field of Classification Search ..... 200/339; 206/278, 279, 285, 289–291, 296, 490, 491, 206/493, 495; 294/145, 159
See application file for complete search history.

(56) References Cited

U.S. PATENT DOCUMENTS 1,598,340 A * 8/1926 Decher ..... 211/96
1,722,757 A * 7/1929 Levine ..... 248/201
1,815,673 A * 7/1931 Kelley ..... 211/119
1,919,082 A * 7/1933 Wheary ..... 206/289
2,455,478 A * 12/1948 Grant ..... 223/88
3,633,802 A * 1/1972 Webster ..... 294/143
4,123,012 A * 10/1978 Hough ..... 242/405.2
(Continued)

FOREIGN PATENT DOCUMENTS

EP 1414109 A2 4/2004

OTHER PUBLICATIONS

U.S. Appl. No. 11/418,732, filed May 4, 2006, Neu et al.

(Continued)

*Primary Examiner* — J. Gregory Pickett
*Assistant Examiner* — Kaushikkumar Desai
(74) *Attorney, Agent, or Firm* — Patterson Thuente Christensen Pedersen, P.A.

(57) ABSTRACT

The container of this invention may have a plurality of slots formed proximate an upper perimeter of the container such that a lower portion of the slots is exposed when a lid is secured over the upper perimeter. Optionally a plurality of notches may be formed in the container below the slots. Hooks of tie down straps engage the slots and are held in place therein by the lid. When the slots are present hooks of tie down straps are secured in the slots. Another embodiment includes a hanger having a handle and an optional L-piece, the handle having apertures or notches, which can be, for example oval or rectangular, for securing both hooks of a tie down strap, the L-piece either attachable, or permanently attached, to the handle for further securing the hooks disposed in the apertures. Yet another embodiment includes a receptacle having an attachable or permanently attached bracket or plurality of brackets, each bracket having slots, each slot for storing both hooks of a tie down strap. Each receptacle may have optional slots for storing elastic straps.

10 Claims, 21 Drawing Sheets

U.S. PATENT DOCUMENTS

| | | | | | |
|---|---|---|---|---|---|
| 4,632,285 | A | * | 12/1986 | Dillingham | 223/88 |
| 4,842,458 | A | * | 6/1989 | Carpenter | 410/3 |
| 4,863,020 | A | * | 9/1989 | Klemow | 206/702 |
| 4,984,685 | A | | 1/1991 | Douglas | |
| 5,020,759 | A | * | 6/1991 | Weber | 248/309.2 |
| 5,143,228 | A | * | 9/1992 | Arnold | 211/70.6 |
| D330,323 | S | * | 10/1992 | Hu | D8/359 |
| 5,421,457 | A | | 6/1995 | Listenberger | |
| 5,449,067 | A | | 9/1995 | Cannon | |
| 5,788,092 | A | * | 8/1998 | Teeney | 211/70.6 |
| 5,803,519 | A | * | 9/1998 | Daigle | 294/159 |
| 6,099,060 | A | * | 8/2000 | Towers | 294/159 |
| 6,102,206 | A | * | 8/2000 | Pride | 206/454 |
| 6,202,905 | B1 | * | 3/2001 | Heide | 223/94 |
| 6,290,440 | B1 | | 9/2001 | DiViccaro | |
| 6,607,169 | B1 | * | 8/2003 | Gershfeld | 248/65 |
| 6,957,938 | B1 | | 10/2005 | Beasley | |
| 6,968,955 | B2 | | 11/2005 | Steeber | |
| 7,131,608 | B2 | | 11/2006 | Breeden, III et al. | |
| 7,387,211 | B2 | * | 6/2008 | Anspach | 211/13.1 |
| 2005/0035919 | A1 | | 2/2005 | Yang et al. | |
| 2005/0145747 | A1 | | 7/2005 | Breeden, III et al. | |
| 2006/0284780 | A1 | | 12/2006 | Chen et al. | |
| 2007/0284326 | A1 | * | 12/2007 | Baloun | 211/182 |
| 2008/0068216 | A1 | | 3/2008 | Borisov et al. | |
| 2009/0283486 | A1 | * | 11/2009 | Reason-Kerkhoff | 211/85.7 |

OTHER PUBLICATIONS

Office Action and PTO-892 mailed Jul. 16, 2008 in U.S. Appl. No. 11/418,732, 10 pages.

* cited by examiner

*Fig.* 14
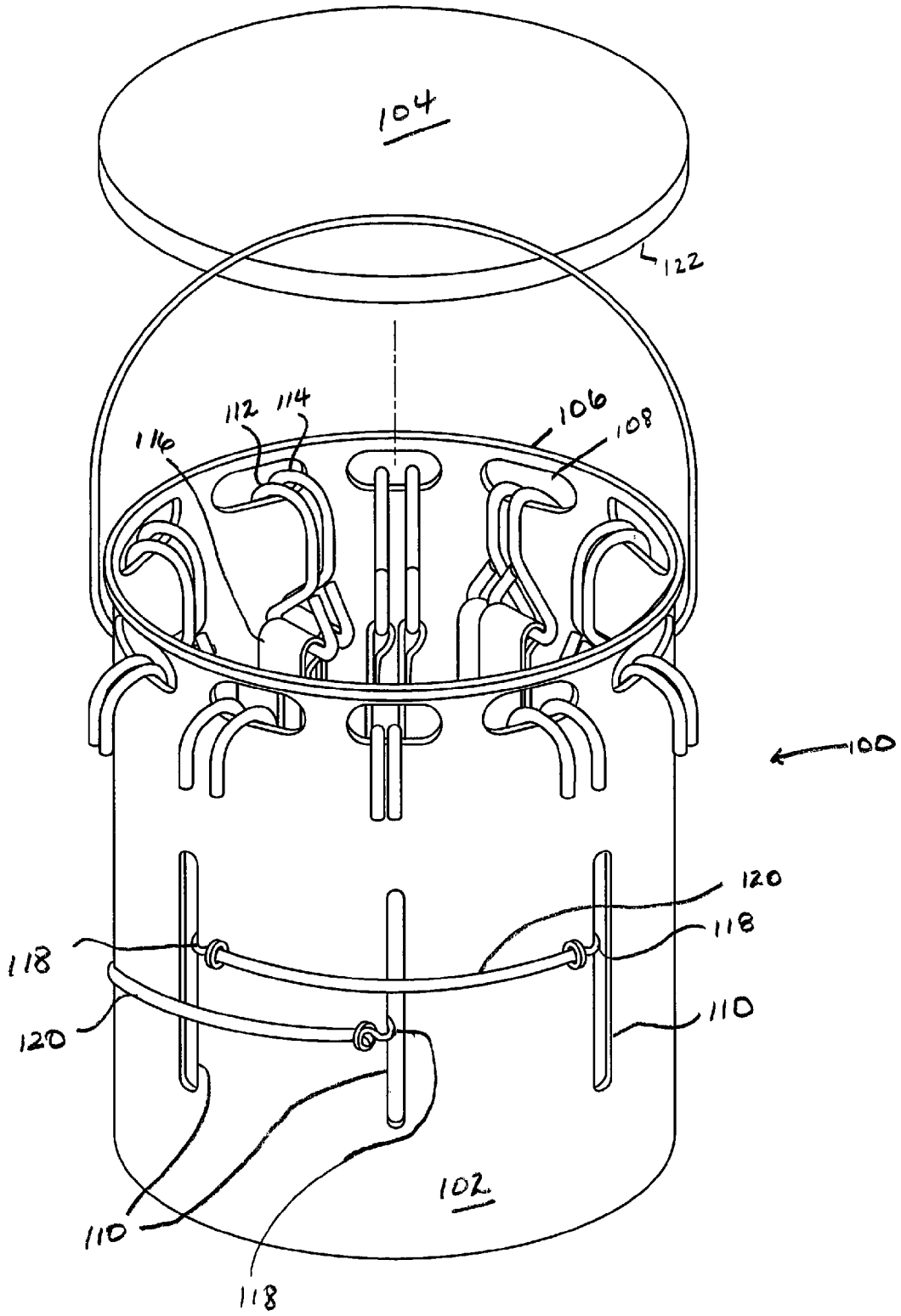

MULTIPLE SIZE STRAP AND TIE DOWN CONTAINER

CROSS-REFERENCES TO RELATED APPLICATIONS

This is a continuation-in-part of U.S. patent application Ser. No. 11/418,732, filed May 4, 2006, now abandoned, which, in turn, claims priority under 35 U.S.C. §119 (e) to U.S. Provisional Application No. 60/677,574, filed 4 May 2005, each of the foregoing applications hereby incorporated by reference.

BACKGROUND OF THE INVENTION

1. Field of the Invention

This invention relates to containers and, in particular, this invention relates to containers for storing and securing tie down straps.

2. Background

Tie down straps are used to secure items in place in a vast number of activities. When not being used, numbers of tie down straps are often stored in containers. When stored thusly, the tie down straps frequently become tangled together, and become inconvenient to separate for use. Alternatively, each tie down strap must be rolled or folded for storage, thereby requiring time to store and additional time to unroll or unfold the tie down strap before use.

There is then a need for a container to store tie down straps where they are quickly and efficiently stored without being rolled or folded, yet available for use without the necessity of being separated.

SUMMARY OF THE INVENTION

This invention substantially meets the aforementioned needs of the industry by providing a container in which tie down straps can be efficiently stored without being rolled or folded and from which the stored tie down straps are available without being untangled, unfolded or unrolled. In one aspect, the invention organizes tie down straps and avoids entanglement of these straps by securing both hooks of each tie down strap. The inventors have determined surprisingly that, if hooks are secured, the remainder of a tie down strap, whether elastic or inelastic in nature, does not become entangled with other tie down straps being stored. Accordingly, the tie down strap can be easily removed from a device of this invention for use; then placed back in such device for subsequent storage, each without encountering tangles with other stored tie down straps.

It is therefore one object of this invention, to provide a container for storing and securing a plurality of tie down straps, the tie down straps having a first hook at a first end and an optional second hook at a second end of a flexible member, the container including a removable lid and a side wall, the side wall with an upper perimeter and a plurality of notches disposed proximate the upper perimeter, a lower portion of at least one of the notches extending below the lid when the lid is secured over the upper perimeter. The plurality of notches may extend from the upper perimeter. A plurality of slots may be formed in the side wall such that the slots are disposed below the notches. The slots may be generally vertical in orientation. In selected embodiments, the container may have a generally circular or a generally rectangular cross section. The lid may be configured as a seat.

It is another object of this invention to provide a method of manufacturing a container with a removable lid disposable over an upper perimeter of the container. The method may include forming a plurality of notches proximate the upper perimeter such that a lower portion of each, or at least one, notch extends below the lid when the lid is secured over the upper perimeter.

It is yet another object of this invention to provide a method of securing a tie down strap in a container. The method may include engaging a first hook of a tie down strap in a notch, the notch disposed proximate an upper perimeter of the container, the tie down strap comprising the first hook, an optional second hook, and a flexible member, the first and second hooks attached to each end of the flexible member. This method may include securing a lid over the upper perimeter of the container such that a lower portion of the notch extends below the lid. This method may yet further include engaging a first hook of another tie down strap in a first slot disposed below the notch and engaging a second hook of the other tie down strap in a second slot also disposed below the notch.

It is still another embodiment of this invention to provide a system for storing tie down straps comprising a hanger, the hanger comprising a handle and a lower portion, the lower portion depending from the handle and including a plurality of apertures, each aperture dimensioned and positioned to accommodate a pair of hooks disposed at the end of a tie down strap. The apertures may be oval, rectangular, or any other suitable geometrical shape. An L-piece having vertical and horizontal elements may be used to secure the hooks in place in the foregoing apertures. The L-piece may be permanently attached to the hanger or may be attached by sliding the horizontal element through a longitudinal slot in the hanger and secured by one or straps. The hanger may be utilized as the sole means of storage and transport. However, the hanger may be stored or transported by being secured by means of slots in a receptacle, then optionally further secured in the receptacle by means of a lid, the lid contacting or closely proximate the hanger.

It is one feature of an embodiment of the container of this invention that a plurality of notches are formed proximate, or extending from, an upper perimeter of the container, such that a lower portion of each, or at least one, of the notches extends beneath the lid when the lid is secured to the container. It is an advantage of this feature that the tie down straps are secured in place when the lid is secured to the container. It is another advantage of this feature that the tie down straps are easily removed from the container when the lid is removed from the container. It is yet another advantage of this feature that the tie down straps are stored such that they are easily retrieved without the necessity of untangling, unrolling, or unfolding the tie down straps.

It is another feature of one embodiment of the container of this invention that the lid may be configured as a seat. It is an advantage of the foregoing feature that the container of this invention may be used with greater comfort during a desired activity.

It is yet another feature of another embodiment of the container of this invention that a plurality of slots may be formed therein, the slots disposed below the notches. It is an advantage of the foregoing feature that additional tie down straps may be stored by the container of this invention.

It is still another feature of an embodiment of the container of this invention that the container may have a cross section which is generally circular or rectangular. It is an advantage of the foregoing feature that the container of this invention may be shaped as desired for convenient storage and utilization.

These and other objects, features, and advantages of this invention will become apparent from the description which follows, when considered in view of the accompanying drawings.

BRIEF DESCRIPTION OF THE DRAWINGS

FIG. 14 is a perspective view of another embodiment of a multiple size strap and tie down container of this invention, similar to the embodiment of FIGS. 4 and 5, but having oval-shaped apertures;

It is understood that the above-described figures are only illustrative of the present invention and are not contemplated to limit the scope thereof.

DETAILED DESCRIPTION

Any references to such relative terms as above and below, up or down, horizontal or vertical, or the like, are intended for convenience of description and are not intended to limit the present invention or its components to any one positional or spatial orientation. Each of the additional features and methods disclosed herein may be utilized separately or in conjunction with other features and methods to provide improved devices of this invention and methods for making and using the same. Representative examples of the teachings of the present invention, which examples utilize many of these additional features and methods in conjunction, will now be described in detail with reference to the drawings. This detailed description is merely intended to teach a person of skill in the art further details for practicing preferred aspects of the present teachings and is not intended to limit the scope of the invention. Therefore, specific combinations of features and methods disclosed in the following detailed description may not be necessary to practice the invention in the broadest sense, and are instead taught merely to particularly describe representative embodiments of the invention. Hence, a person of ordinary skill in the art will readily appreciate that individual features shown on various embodiments of the present invention are interchangeable to some extent and may be added or interchanged on other embodiments without departing from the spirit and scope of this invention.

Figure 1:
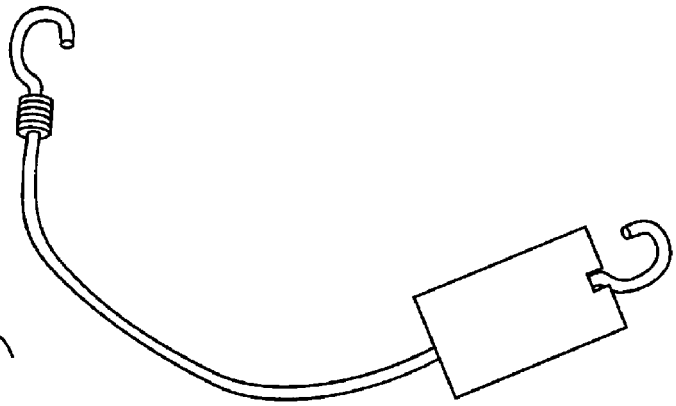
FIG. 1 is a plan view of one type of tie down strap which includes multiple links of an elastic cord with hooks at either end.
Figure 2:
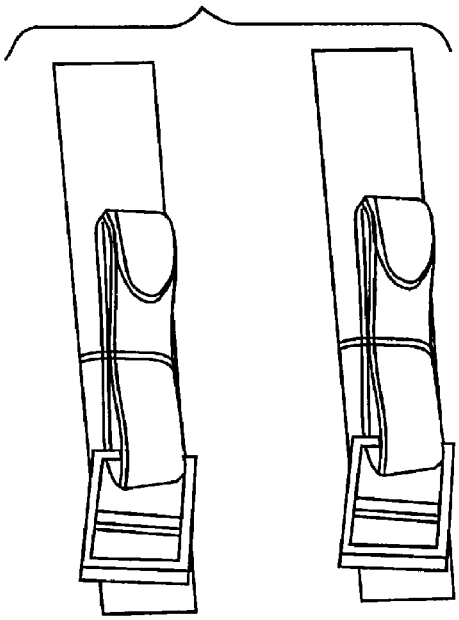
FIG. 2 is a plan view showing another type of tie down strap which includes multiple links of webbing such as a nylon web having hooks at either end and made tight to a load with the use of a cambuckle or ratchet mechanism.
Figure 3:
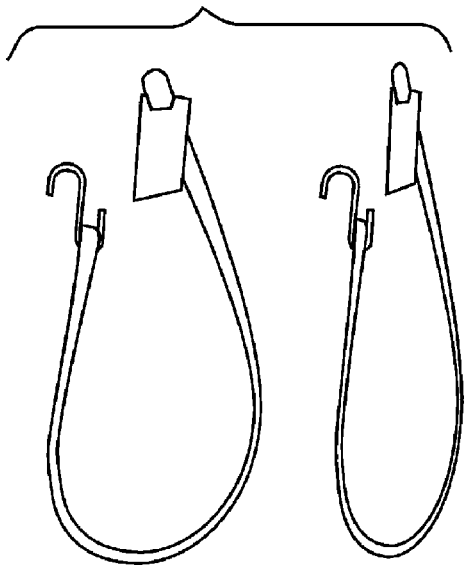
FIG. 3 is a plan view of another type of tie down strap, which includes multiple links of rubber straps with hooks at either end.

As used herein, the term tie down strap designates any of the various tie down and hold down devices that have a flexible member such as a length of rubber, elastic cord, cable, wire, synthetic web, or the like, having a first hook at a first end and an optional second hook on a second end thereof. Tie down strap may alternately include relatively inelastic straps having hooks at both ends thereof, optionally having a ratchet. Examples of such devices are shown in FIGS. 1, 2, and 3. Typically a user of such devices will have a large number of them on hand for diverse uses. Also typically they are stored together where they tend to become entangled with one another making it tedious to separate a selected tie down strap from the bunch.

Figure 4:
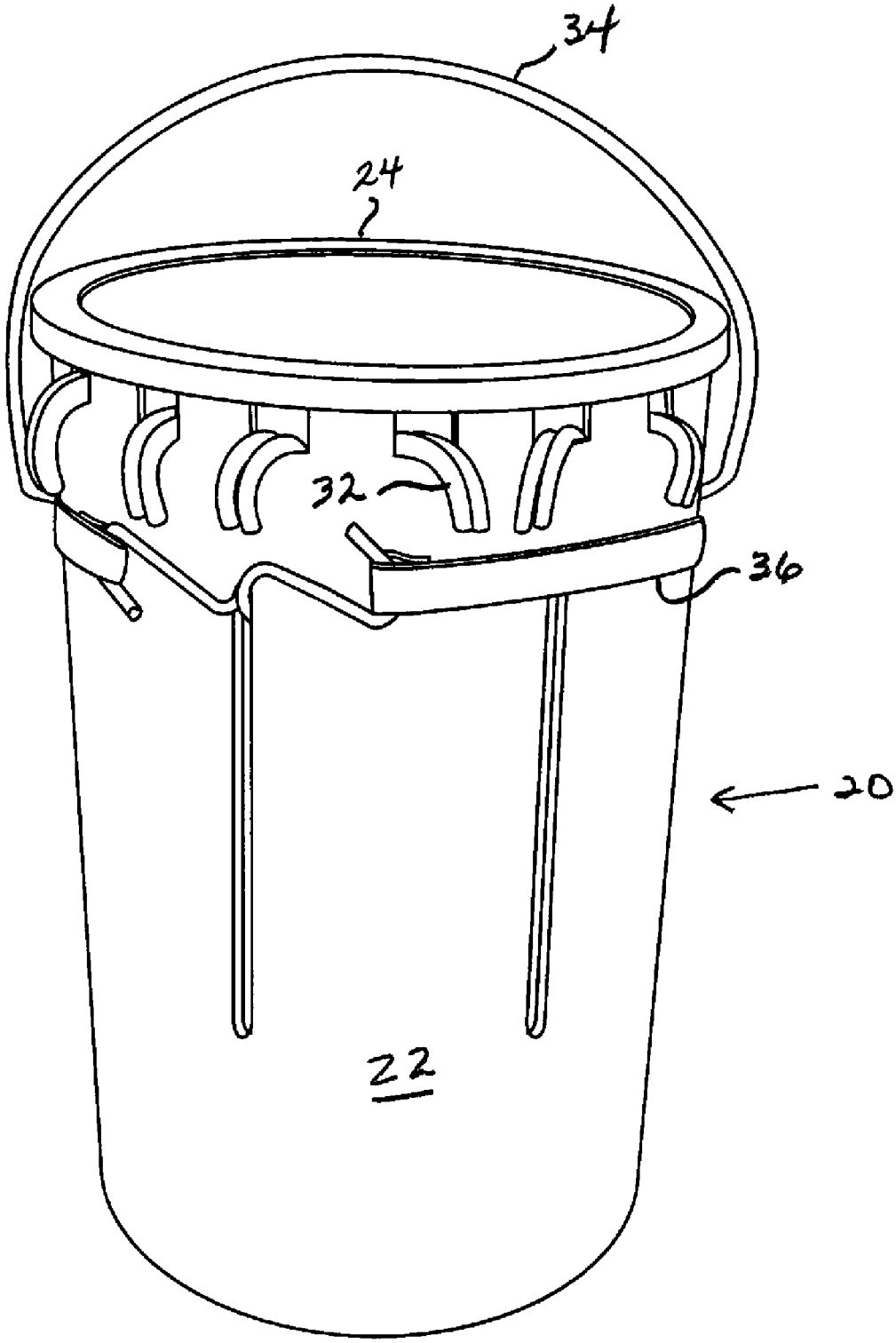
FIG. 4 is a perspective view of one embodiment of a multiple size strap and tie down container of this invention with the lid in place.
Figure 5:
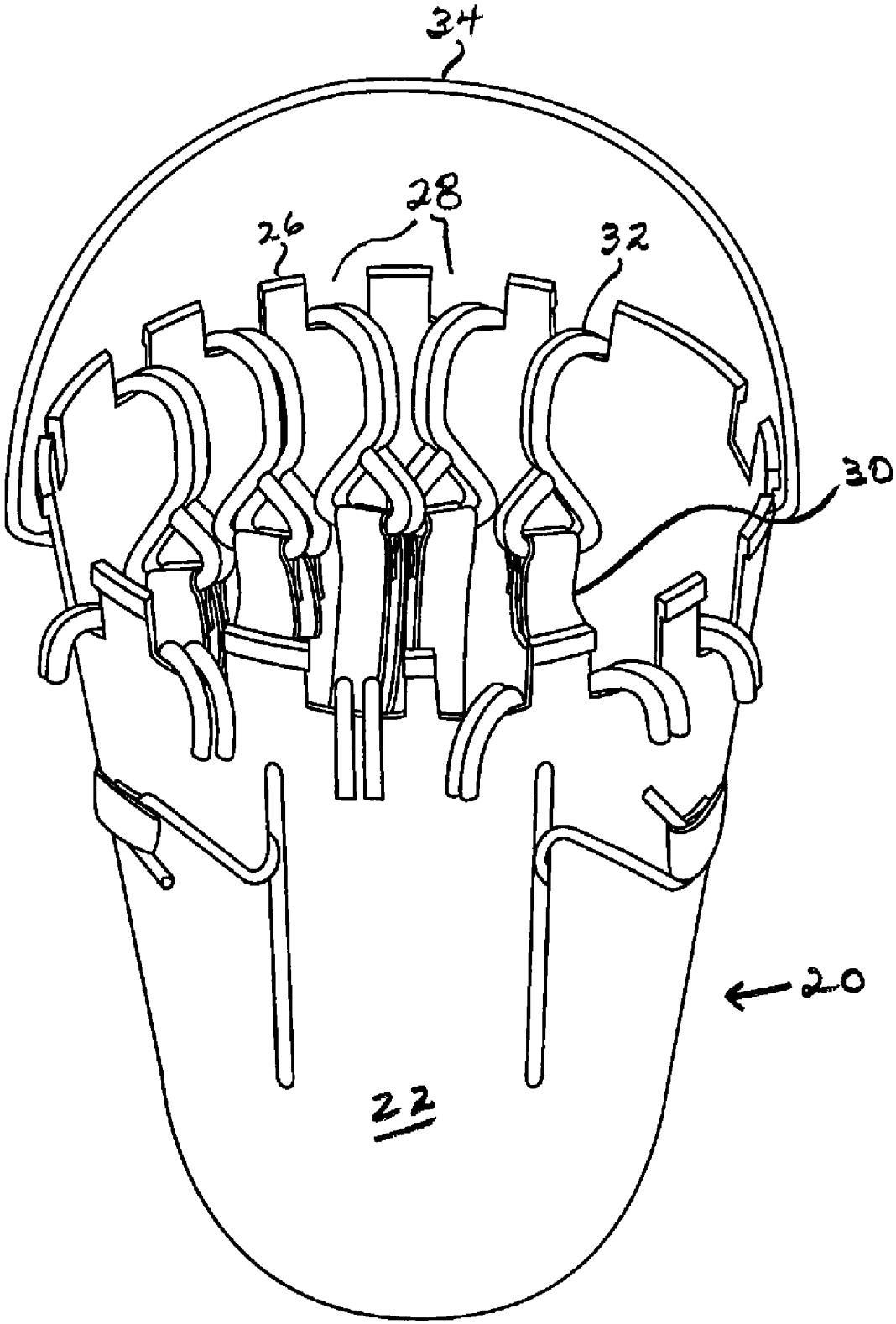
FIG. 5 is a perspective view of the container of FIG. 4 with the lid removed.

FIGS. 4 and 5 show one embodiment of a multiple size strap and tie down container of this invention. The container is shown with the snap-on lid in place in FIG. 4 and with the lid removed in FIG. 5. The container is indicated generally at 20 and includes an open top receptacle 22. Receptacle 22 has a circular cross section and an upwardly divergent side wall in the shape of a common bucket. Receptacle 22 has an upper perimeter 26. A plurality of notches 28 are formed in the perimeter 26. Notches 28 are formed for the purpose of accommodating the hooks of tie down strap devices such as described above. As shown in FIG. 5, a plurality of tie down straps 30 are stored in the receptacle 22. The various hooks 32 of the tie down straps 30 engage in the notches 28. The remainder of each of the tie down straps is contained within the interior of receptacle 22. As contained in the receptacle, the tie down straps are neatly organized and readily accessible by the user when needed. Additional tie down straps such as the elastic tie down strap 36 shown in FIG. 4 can be stored on the container 20 by being wrapped around the perimeter thereof as shown.

Figure 6:
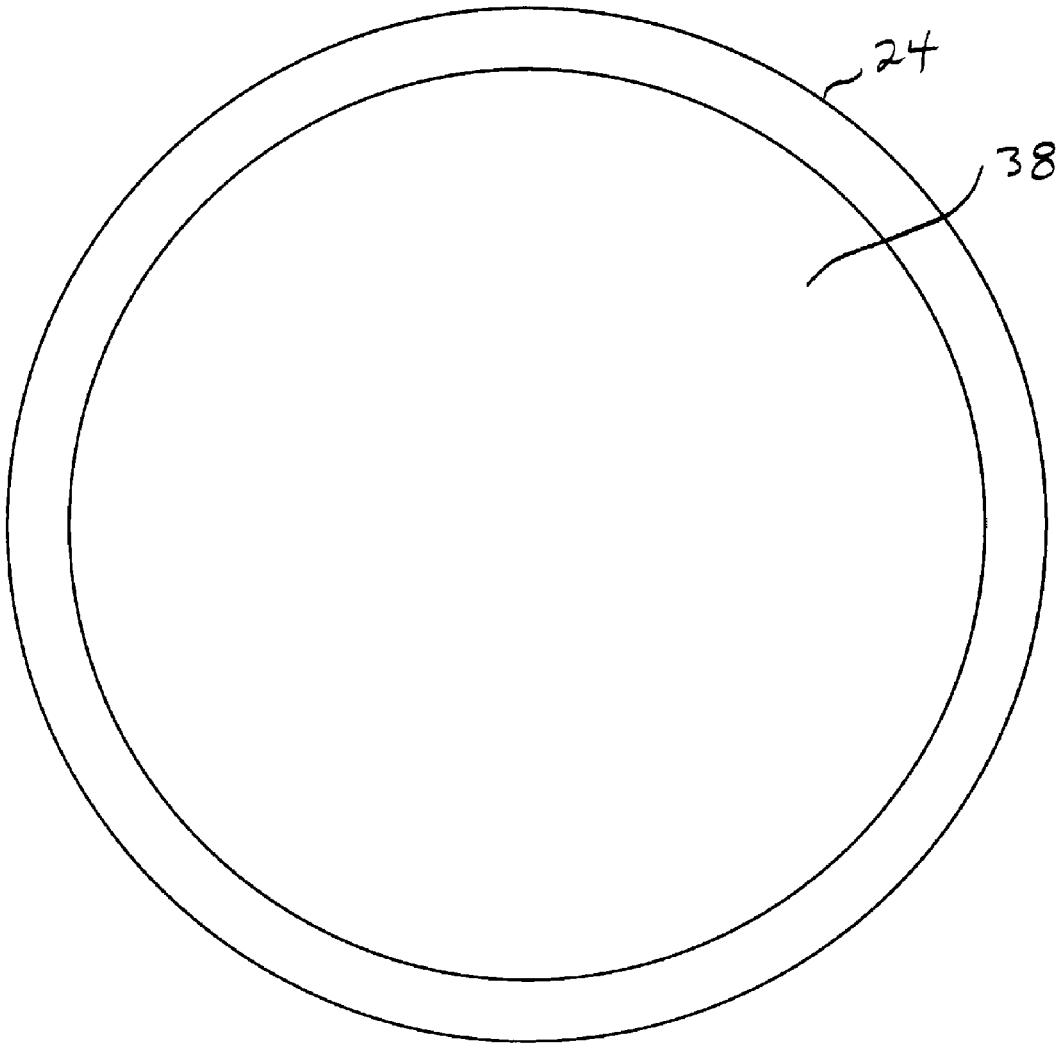
FIG. 6 is a top view of the container of FIG. 4 showing the top surface of the lid.

Lid 24 snaps on the top of the receptacle 22 as shown in FIG. 4. When the lid 24 is in place, the various hooks 32 are restrained from outward movement from the notches 28. FIG. 6 shows that the lid 24 can optionally have a textured outwardly facing surface 38. When the lid 24 is in place on the receptacle 22, the container can be used as a seat.

A handle 34 is connected to the receptacle 22 for moving the container 20 from place to place.

Figure 7:
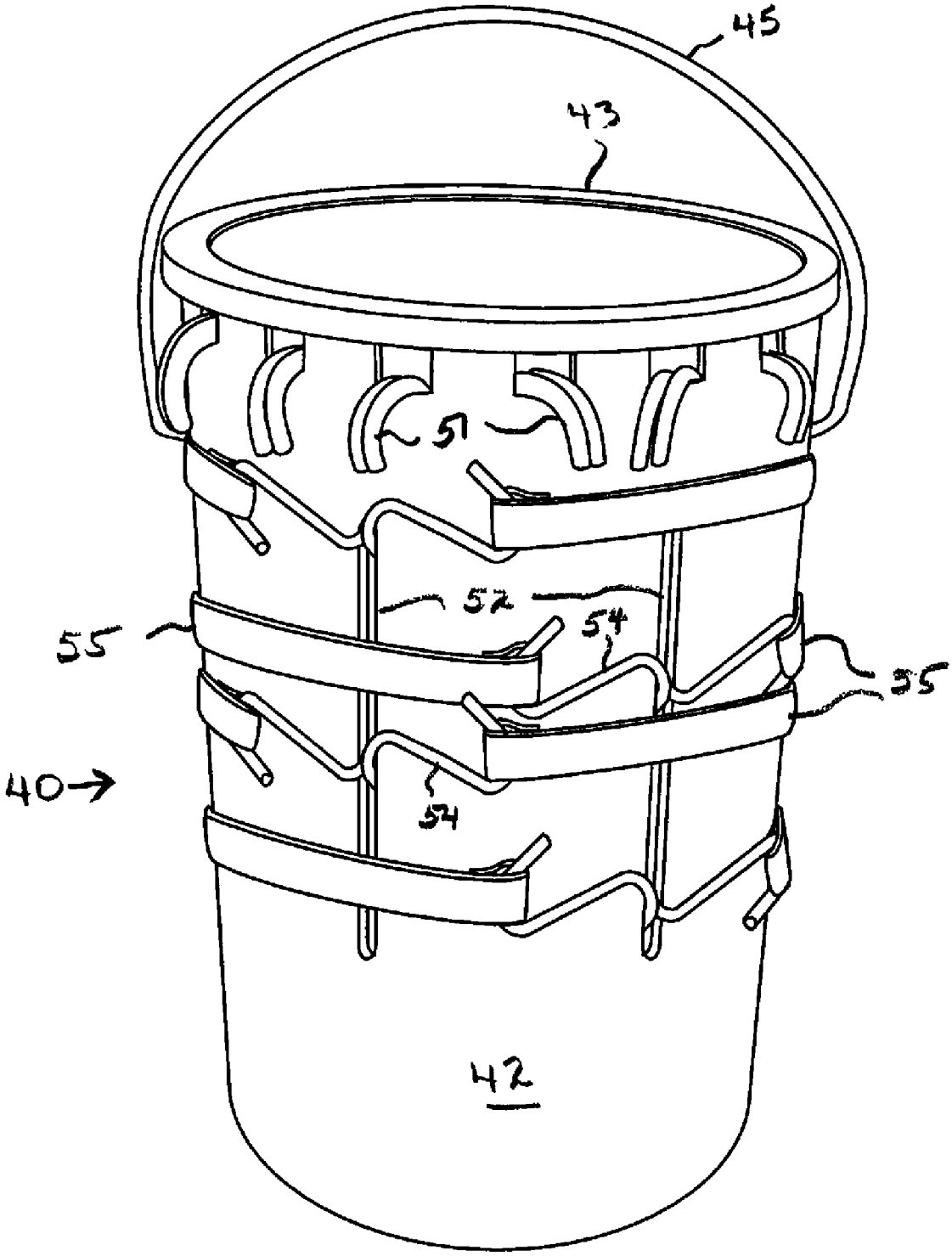
FIG. 7 is a perspective view of another embodiment of a multiple size strap and tie down container of this invention with the lid in place.
Figure 8:
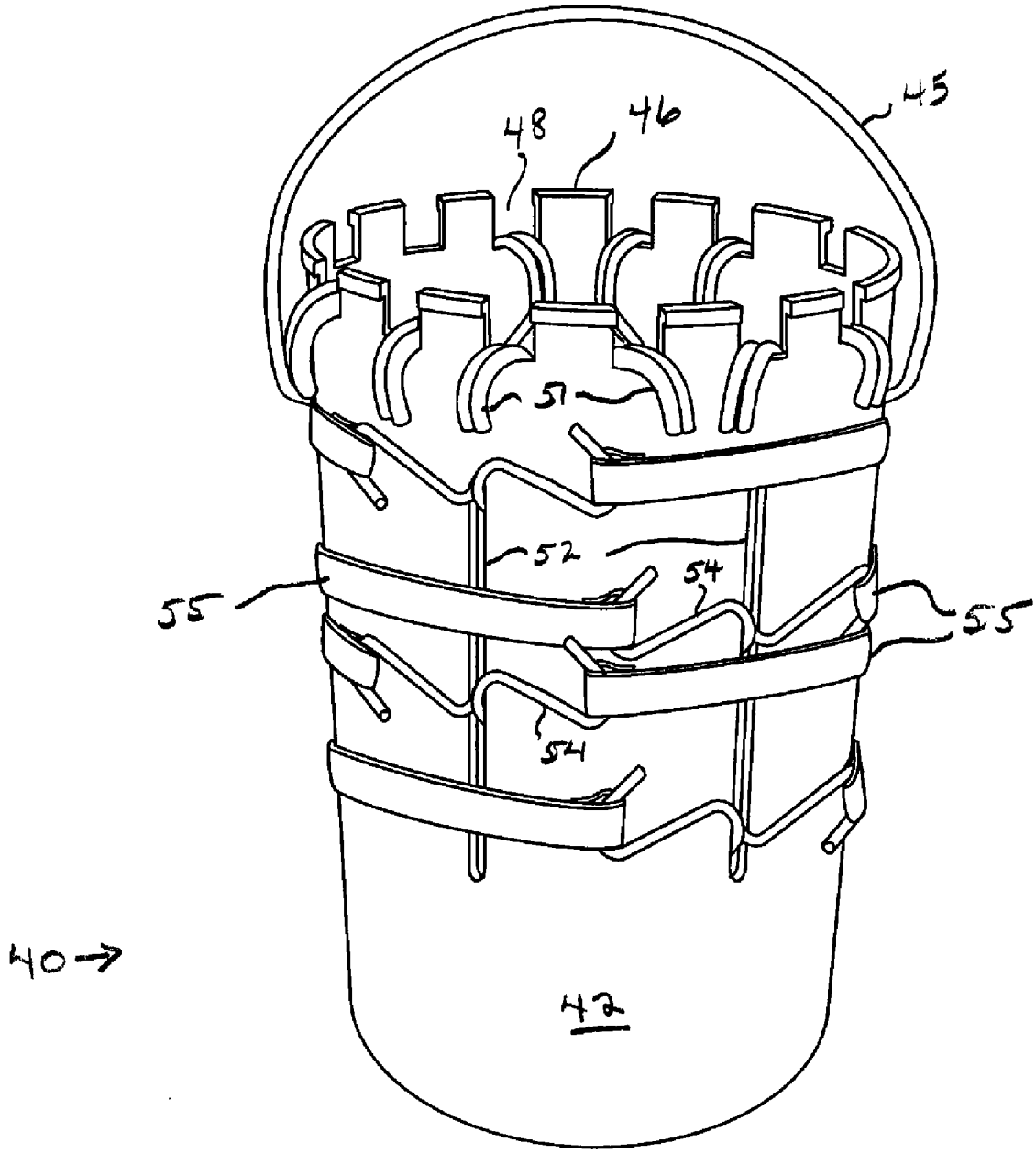
FIG. 8 is a perspective view of the container of FIG. 7 with the lid removed.
Figure 9:
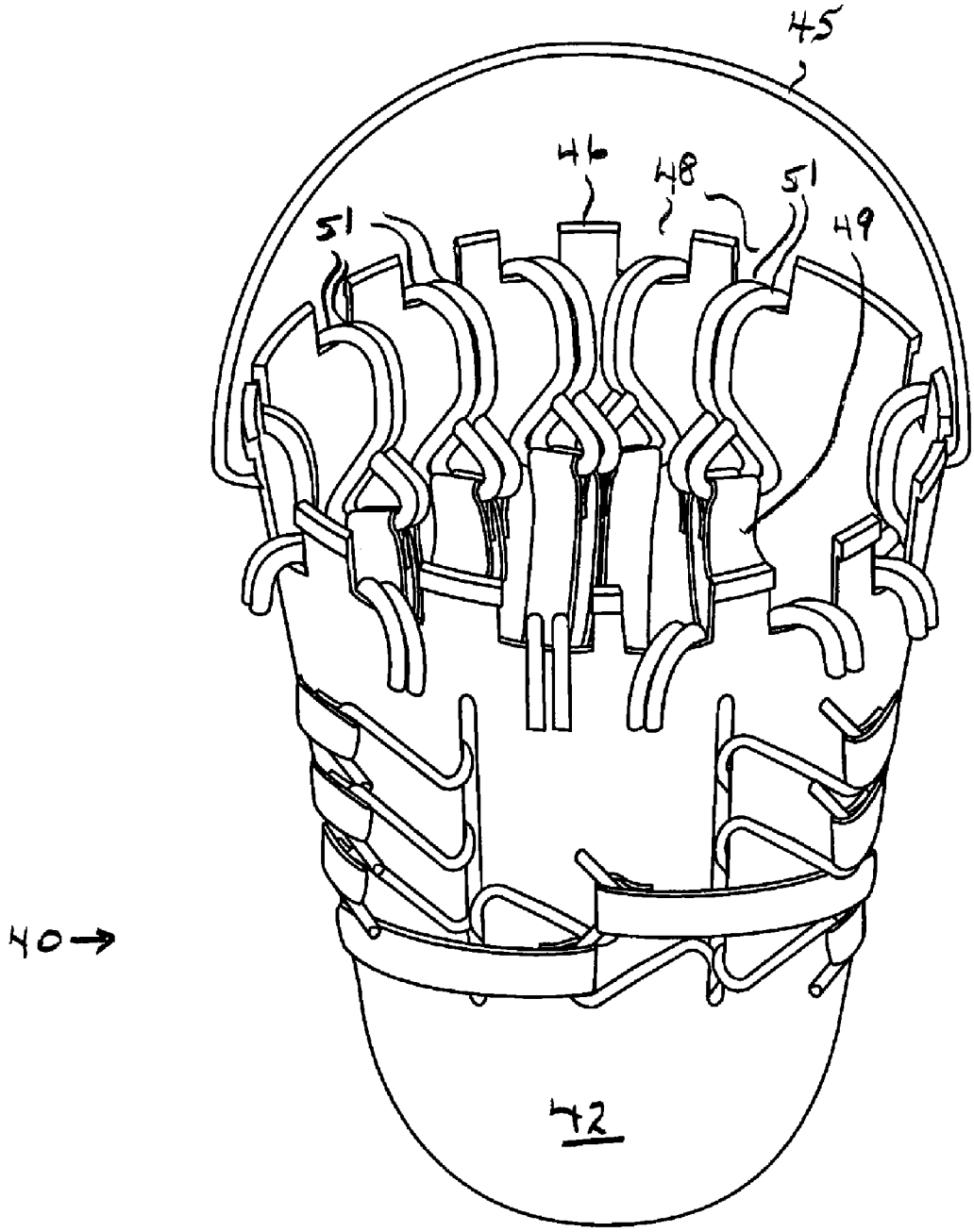
FIG. 9 is a view of the container of FIG. 7 with the lid removed and taken from an elevated perspective to show the straps contained therein.

FIGS. 7 through 9 show a modification of a multiple size strap and tie down container of this invention indicated generally at 40. Container 40 is similar to the container 20 shown in FIGS. 4 and 5, having an upwardly open receptacle 42 that is closed by a lid 43. A handle 45 is attached to the receptacle 42. The receptacle 42 has an upper perimeter 46. A plurality of notches 48 are formed in the perimeter 46. The notches 48 accommodate the hooks 51 of a plurality of tie down straps 49 stored in the receptacle 42. As shown in FIG. 9, pairs of hooks 51 corresponding to a single strap can be accommodated in a single notch 48 for ease of access.

In addition, the receptacle 42 has a plurality of elongated slots 52 that are formed in the side thereof. The slots 52 can be generally vertical. The slots 52 hold hooks 54 of various elastic tie downs 55 that are wrapped around the receptacle 42 as shown in FIG. 7.

Figure 10:
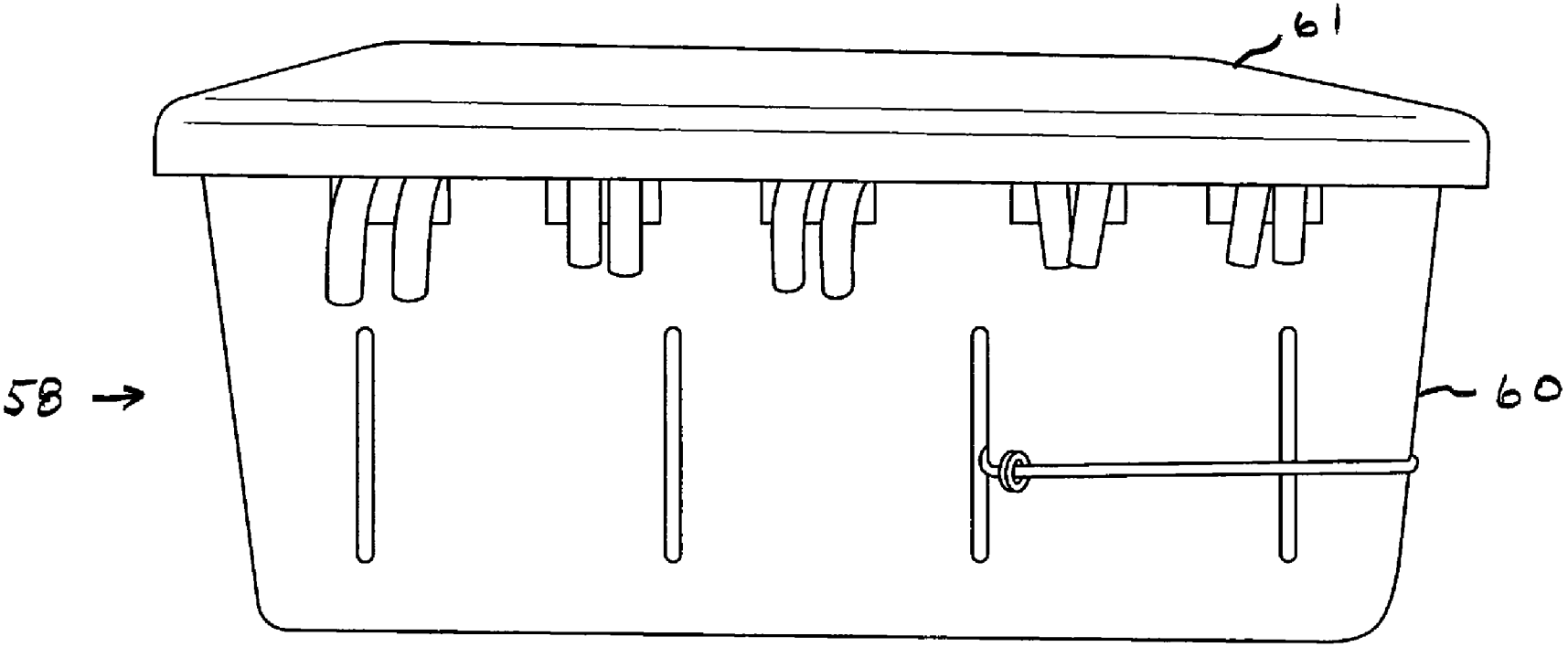
FIG. 10 is a view of another embodiment of a multiple size strap and tie down container of this invention with the lid in place.
Figure 11:
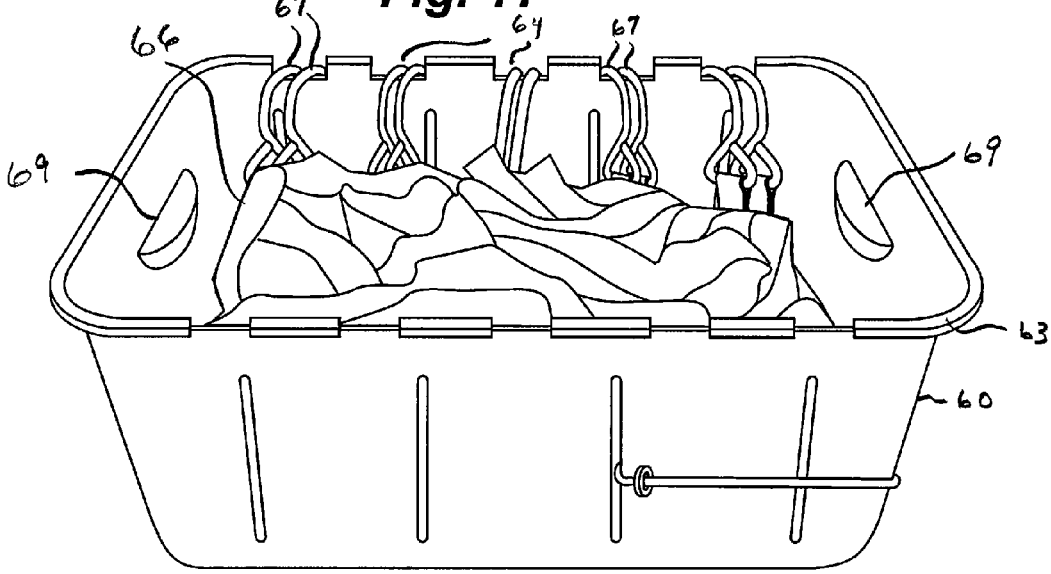
FIG. 11 is a perspective view of the container of FIG. 10 with the lid removed.
Figure 12:
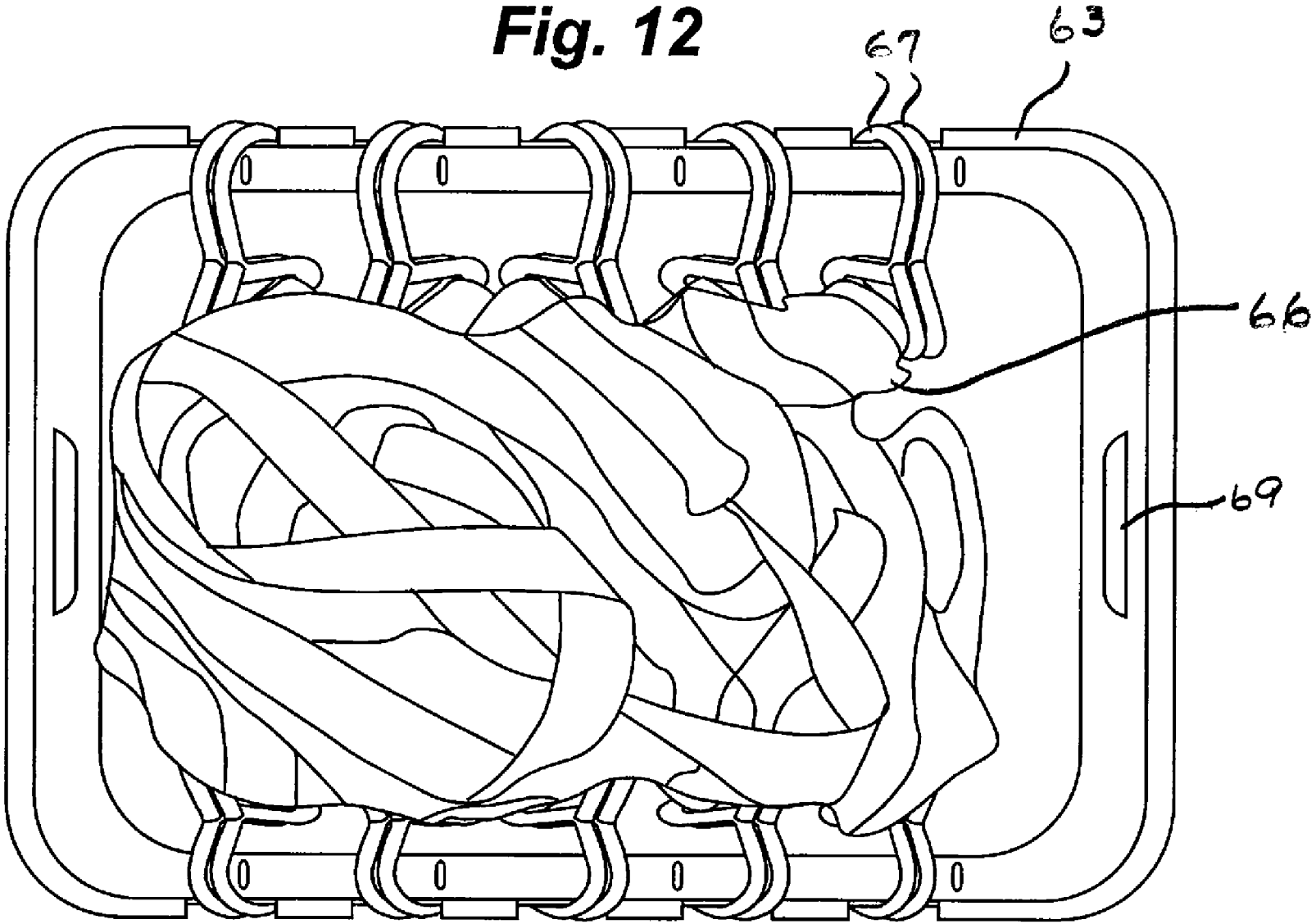
FIG. 12 is a plan view of the container of FIG. 10 with the lid removed, taken from an elevated perspective to show the straps contained therein.

FIGS. 10 through 12 show another embodiment of a multiple size strap and tie down container of this invention. The multiple size strap and tie down container is indicated generally at 58 and includes an upwardly open receptacle 60 that is closed by a snap-on lid 61. The receptacle 60 is rectangular in cross sectional shape and can have transparent or opaque walls. The receptacle 60 has an upper curve-over perimeter 63 that has a plurality of spaced apart notches 64 formed therein. A number of tie down straps 66 are located in the receptacle 63 having hooks 67 that are engaged in the various notches 64. The hooks 67 can be arranged in pairs according to the corresponding tie down strap. The tie down straps are easily accessible from the interior of the receptacle 60 simply by grasping the hooks thereof.

When the lid 61 is snapped in place as shown in FIG. 10, the hooks 67 are restrained from movement. The receptacle 60 has integrally formed handles 69 at either end thereof for transporting the container 58 from place to place.

Figure 13:
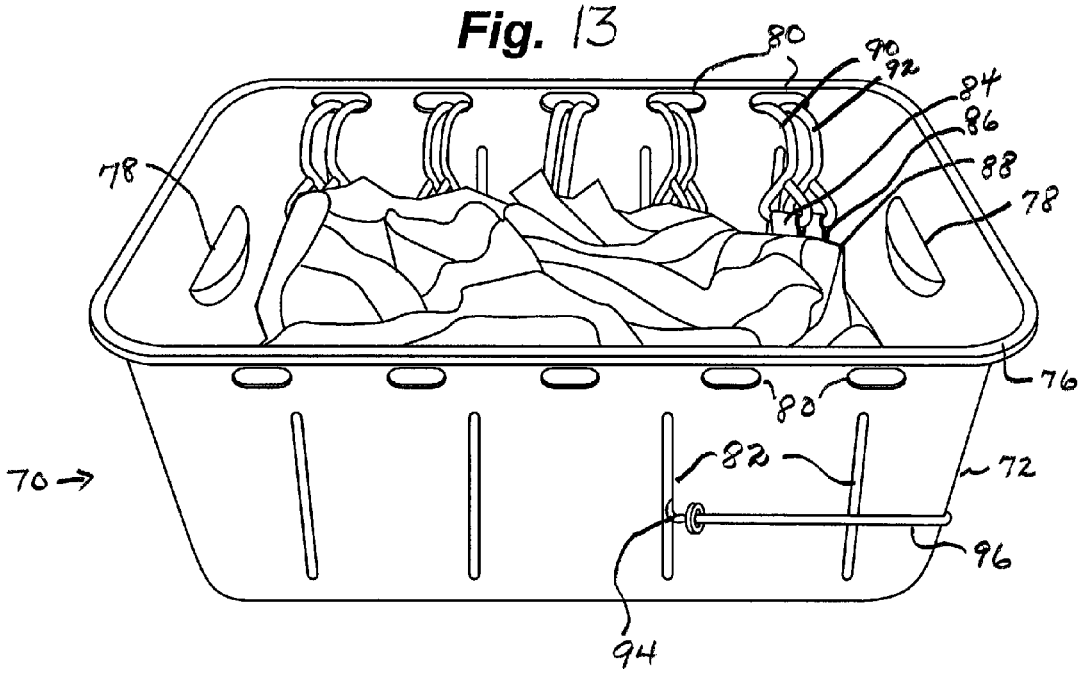
FIG. 13 is a perspective view of another embodiment of a multiple size strap and tie down container of this invention having oval-shaped apertures.

Referring to FIG. 13, another embodiment of the container of this invention is depicted generally at 70 and includes a receptacle 72 and a lid 74 (not shown). The receptacle 72 has an upper perimeter 76 and handles 78 formed therein. In place of the notches formed to extend down from the upper perimeter 76 in previous embodiments, oval slots 80 are present. Also present are wall slots 82, which may be generally vertically oriented in some embodiments. As can be seen, ends 84, 86 of each of tie down straps 88 are attached to hooks 90, 92. The hooks 90, 92 are disposed in the oval slots 80. Hook pairs 94 of each of the elastic tie downs 96 are disposed in one of the wall slots 82. As depicted in FIG. 13, the hooks 90, 92 may be securely retained in the oval slots 80, for example, due to the more confined dimensions within each of the oval slots 80 which prevent vertical movement of the hooks 90, 92. The lid 74, which may be similar to the lid 61, may be secured in a similar fashion to that described above such that the lid 74 contacts, or is in close proximity to, the hooks 90, 92. When present, the lid further limits vertical movement of the hooks 90, 92 to further secure the hooks in place.

Yet another embodiment of the container of this invention is shown in FIG. 14 at 100 and includes a receptacle 102 and a lid 104. The receptacle 102 defines an upper perimeter 106, a plurality of oval slots 108 proximate to, but not extending from, the upper perimeter 106, and a plurality of generally vertical slots 110. In contrast to the notches present in the embodiments depicted in FIGS. 1-11, the oval slots 108 are present to accommodate hooks 112, 114 of a plurality of tie down straps 116. Hooks 118 are disposed in the vertical slots 110 to secure elastic tie downs 120 in place. The hooks 112, 114 may be secured within the oval slots 108 without using the lid 104 in some embodiments. However, the lid 104 may be secured to the receptacle 102 such that a lower edge 122 of the lid 104 contacts, or is in close proximity to, the hooks 112, 114 to thereby limit vertical movement of the hooks and secure the hooks for storage and transport. Use of the lid 104 in this manner thereby further secures the hooks 112, 114 in the oval slot 108.

Figure 15:
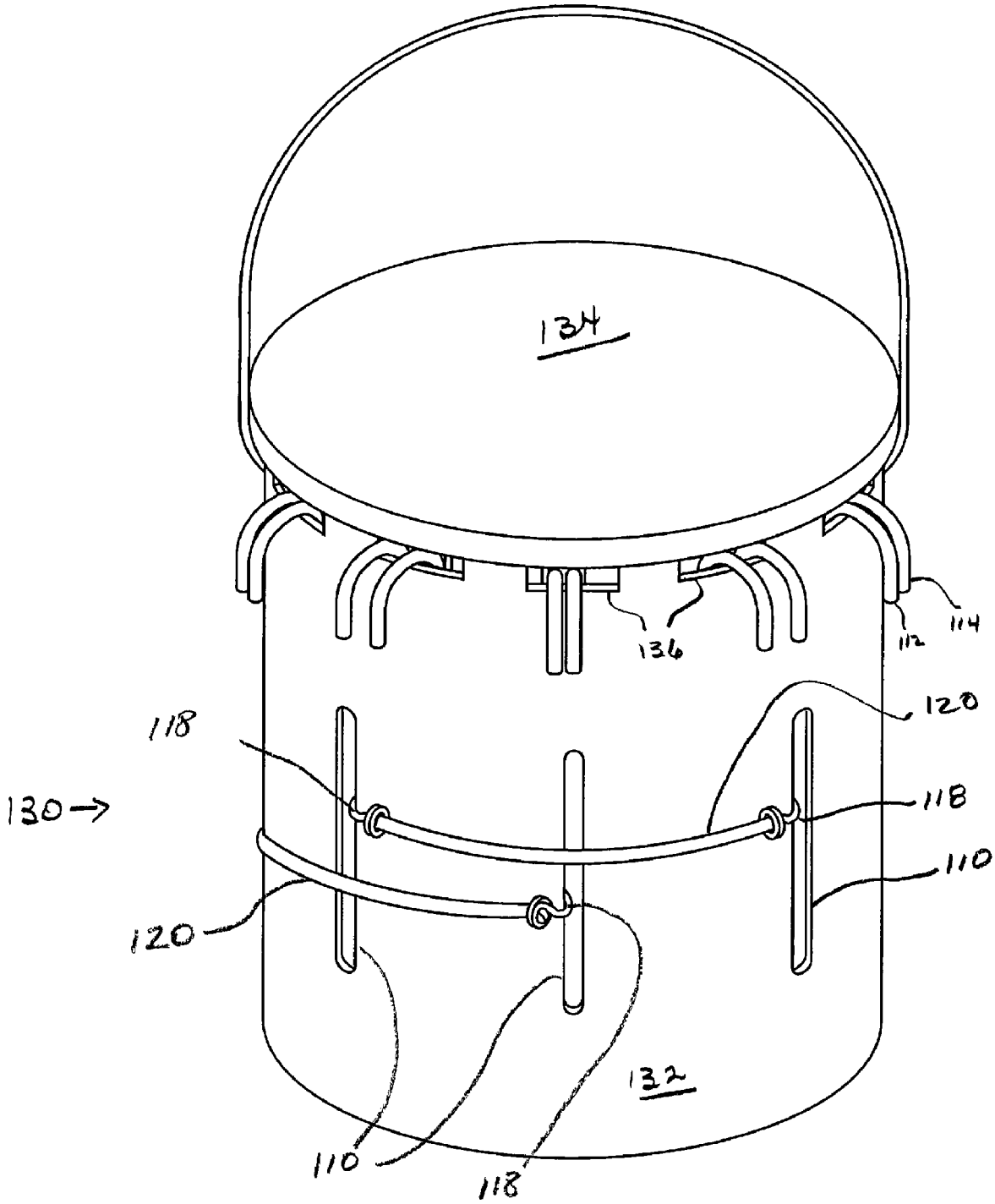
FIG. 15 is a perspective view of the embodiment of FIG. 14 with the lid thereof secured in place.

As shown in FIG. 15, another embodiment of the container of this invention is depicted at 130 and includes a receptacle 132 and a lid 134. The container 130 is substantially similar to the container 100 depicted in FIG. 14, except for the presence of rectangular slots 136. In contrast to the notches of previous embodiments which extend downwardly from the upper perimeter of containers, the rectangular slots 136 are formed so as to have an intact container upper periphery and such that the rectangular slots 136 do not interrupt such upper periphery. As also shown in FIG. 15, the lid 134 may further secure hooks 112, 114 within the rectangular slots 136 in a manner more fully explained above.

Figure 16:
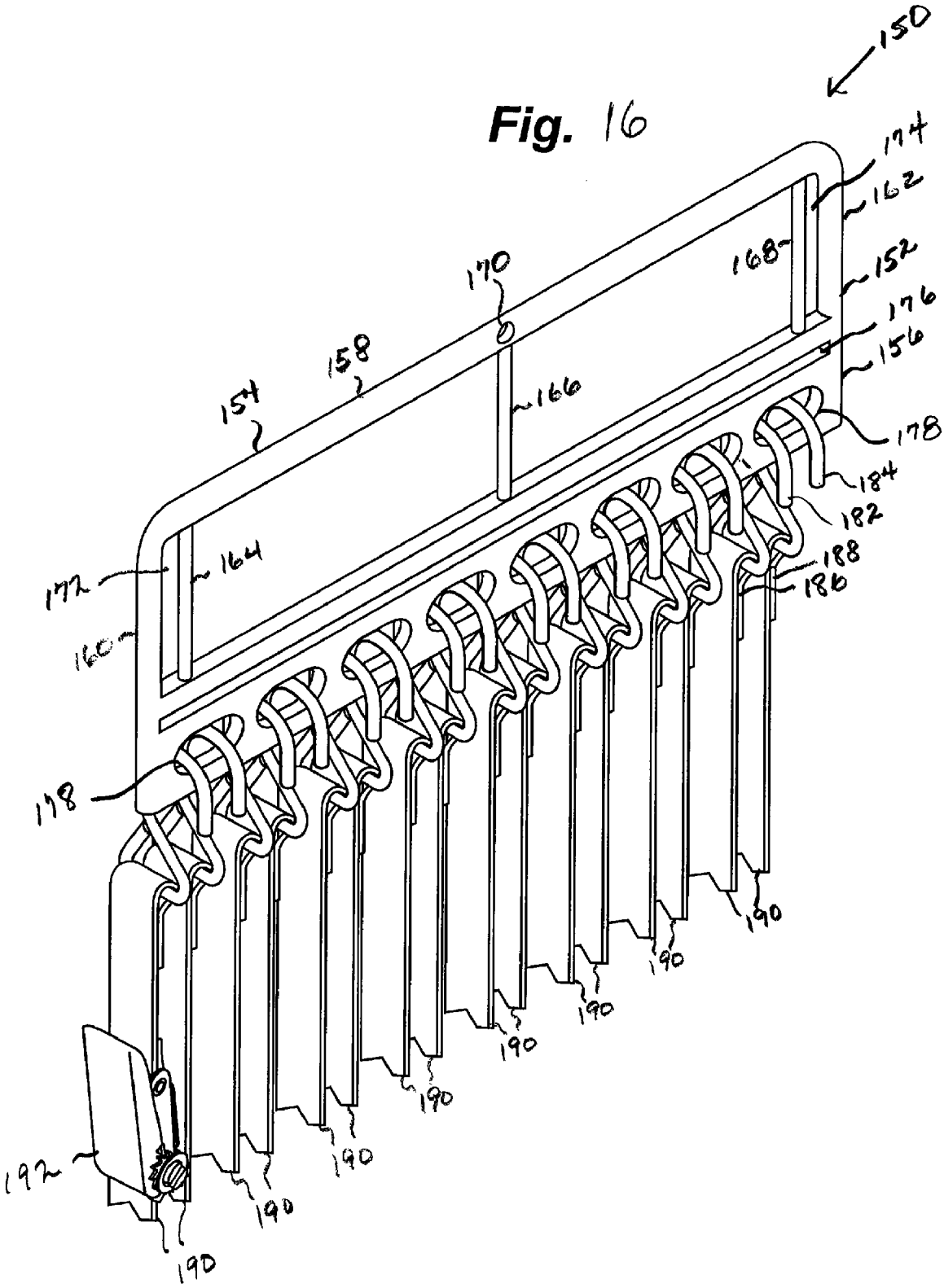
FIG. 16 is a perspective view of an embodiment of a hanger of this invention for storing and transporting tie down straps.
Figure 17:
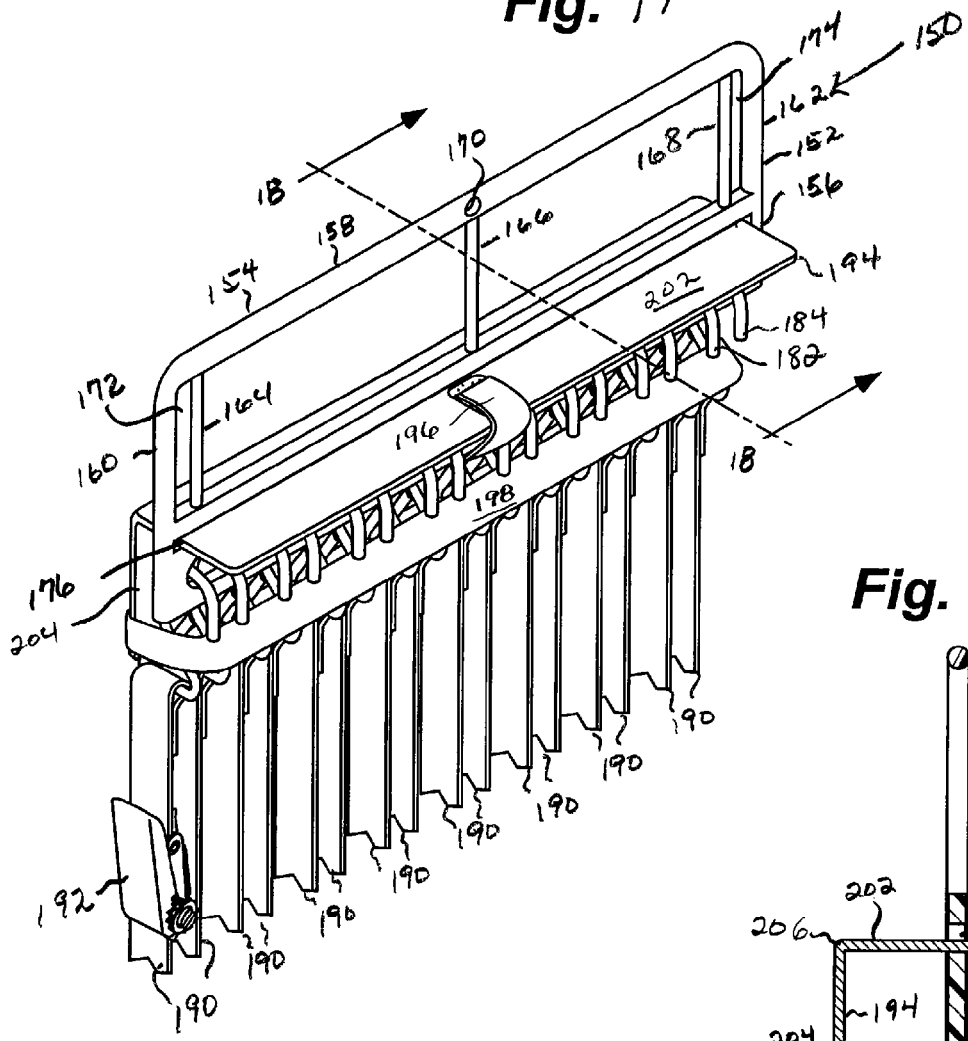
FIG. 17 is a perspective view of the hanger of FIG. 16 with an L-piece of this invention in place therein.
Figure 18:
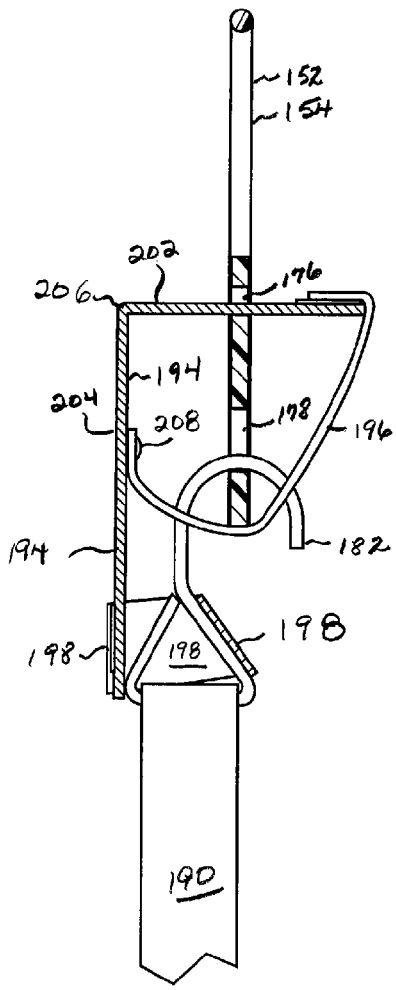
FIG. 18 is a cross sectional view of the hanger of FIG. 17 along line 18-18.

Referring to FIGS. 16-18, another system of this invention for storing tie down straps is shown generally at 150 and includes a hanger 152. The hanger 152, in turn, has a handle 154 and a lower portion 156. The handle 154 has a horizontal element 158 and vertical elements 160, 162 extending downwardly from the horizontal element 158. Vertical members 164, 166, 168 extend between the horizontal element 158 and the lower portion 156. An aperture 170 is defined in the horizontal element 158 generally centrally in the embodiment depicted for hanging the hanger 152 on a nail or hook. Spaces 172, 174 are defined between the vertical member 164 and vertical element 160 and between the vertical member 168 and vertical element 162, respectively, about 16 inches on center in one embodiment to fit nails or hooks driven into studs of a garage, shed, or the like. A longitudinal slot 176 is formed in the lower portion 156. A plurality of oval apertures 178 are defined in the lower portion 156 generally beneath the slot 176. A pair of hooks 182, 184 is disposed in each of the oval apertures 178. The hooks 182, 184 are attached to ends 186, 188 of one of tie down straps 190, some of which may include a ratchet 192. As shown, the hooks 182, 184, hence the tie down straps 190, are secured by being disposed in the oval apertures 178 and may be stored thereby. Each of the tie down straps 190 may be deployed by removing the hooks 182, 184 from one of the apertures 178, then grasping the hooks 182, 184 and gently shaking the tie down 190 to untangle the removed tie down strap 190 from the other tie down straps 190 stored and secured in the system 150. For storage and as stated above, the spaces 172, 174, optionally spaced apart 16 inches on center, can accommodate nails or hooks attached to studs in a garage, shed, or the like.

Referring more particularly to FIGS. 17 and 18, an L-piece 194 and center (first) and lower (second) straps 196, 198, respectively can be used to further secure the hooks 182, 184 in the apertures 178. The L-piece 194 has a horizontal element 202 joined to a vertical element 204 at a bend 206. The center strap 196 is attached to the vertical element 204, for example, by means of a rivet 208. However, a person of ordinary skill in the art would readily recognize other attachment means, such as other fasteners, screws, glue, hook and loop fasteners, and the like. In one embodiment, one end of the lower strap 198 is attached to a lower portion of the vertical element 204 in the same or in a similar manner as the center strap 196 is attached. The hooks 182, 184 are further secured in the apertures 178 by the L-piece 194 and straps 196, 198 by first extending the L-piece horizontal element 202 through the slot 176 as shown in FIGS. 17 and 18. The center strap 196 is then deployed as shown in FIG. 18 such that the center strap 196 extends beneath the handle 152 and is attached to the horizontal element 202 by a snap arrangement, hook and loop fastener, or the like. An additional method of attaching the center strap 196 to the horizontal element 202 is securing a button extending from the horizontal element 202 through a loop or opening (not shown), which can be formed in an end of the center strap 196. However, a person of ordinary skill in the art will readily recognize other equivalent methods for securing the center strap 196 to the horizontal element 202. The lower strap 198 is then extended beneath the hooks 182, 184 as shown in FIG. 18, then secured to the vertical element 204 such as by using the means described above with respect to securing the center strap 196. To access one or more of the tie downs 190, the straps 196, 198 are detached and the L-piece horizontal element 202 is removed from the slot 176. Then, the hooks 182, 184 are removed from the apertures 178, as described above.

Figure 19:
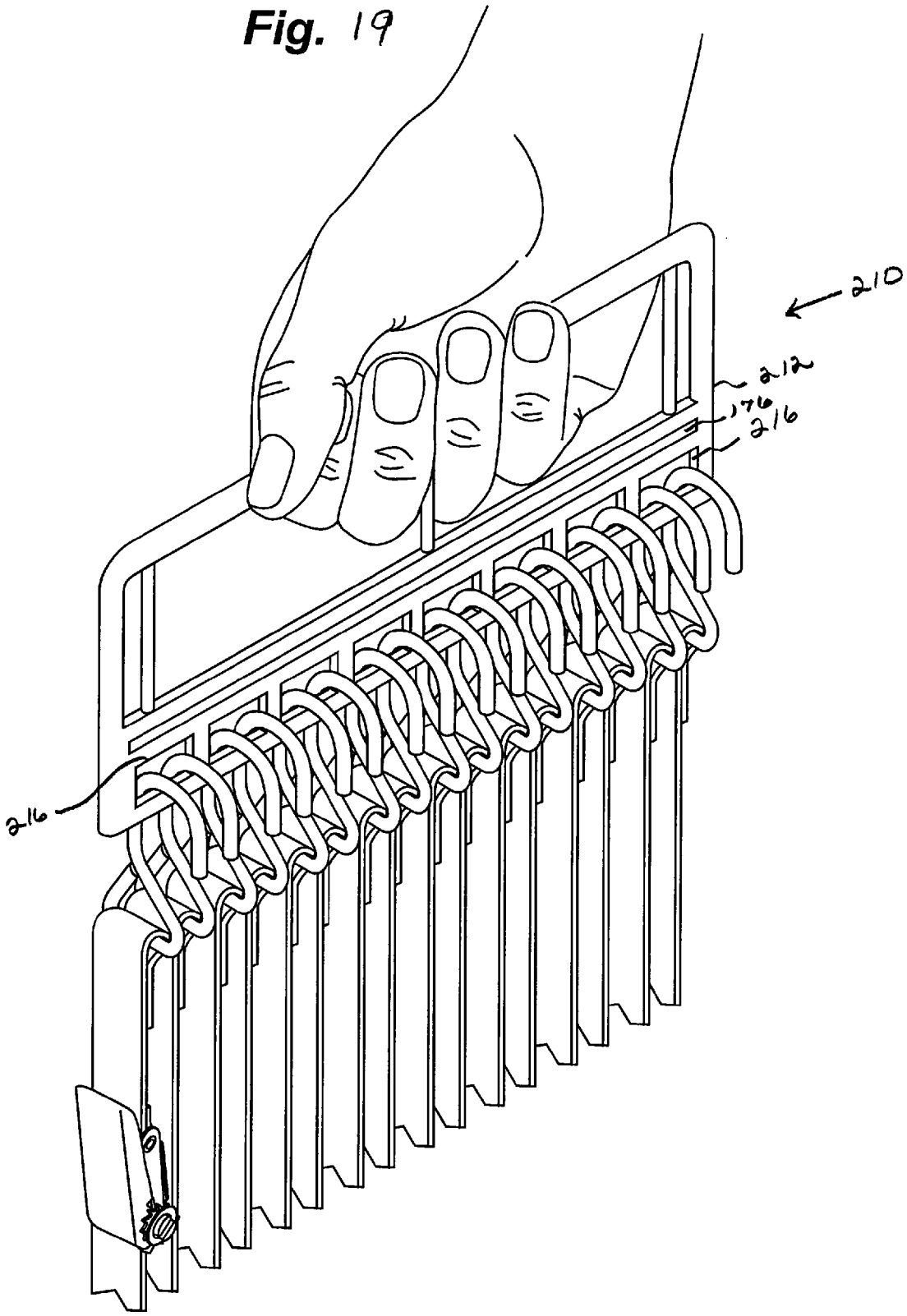
FIG. 19 is a perspective view of another embodiment of the hanger of this invention.

Referring to FIG. 19, the system 210 is shown with a hanger 212. The hanger 212 may be similar to the hanger 152 of the system 150, except for the presence of rectangular apertures 216. While oval apertures such as apertures 178 may be desirable in some embodiments, rectangular apertures such as the apertures 216 may be more desirable in other embodiments. For example, hook dimensions, such as diameters, and cross-sectional configurations, may better function in either rectangular or oval apertures in the context of the storage and retention functions of this invention. The hanger 212, as well as the other hangers of this invention, are conveniently grasped by a user as depicted in FIG. 19. The hangers 152, 212, 222 of this invention can be used alone to store and transport tie down straps as more fully explained herein. However, the hangers 152, 212, 222 may also be advantageously used in combination with a receptacle as is more fully explained below.

Figure 20:
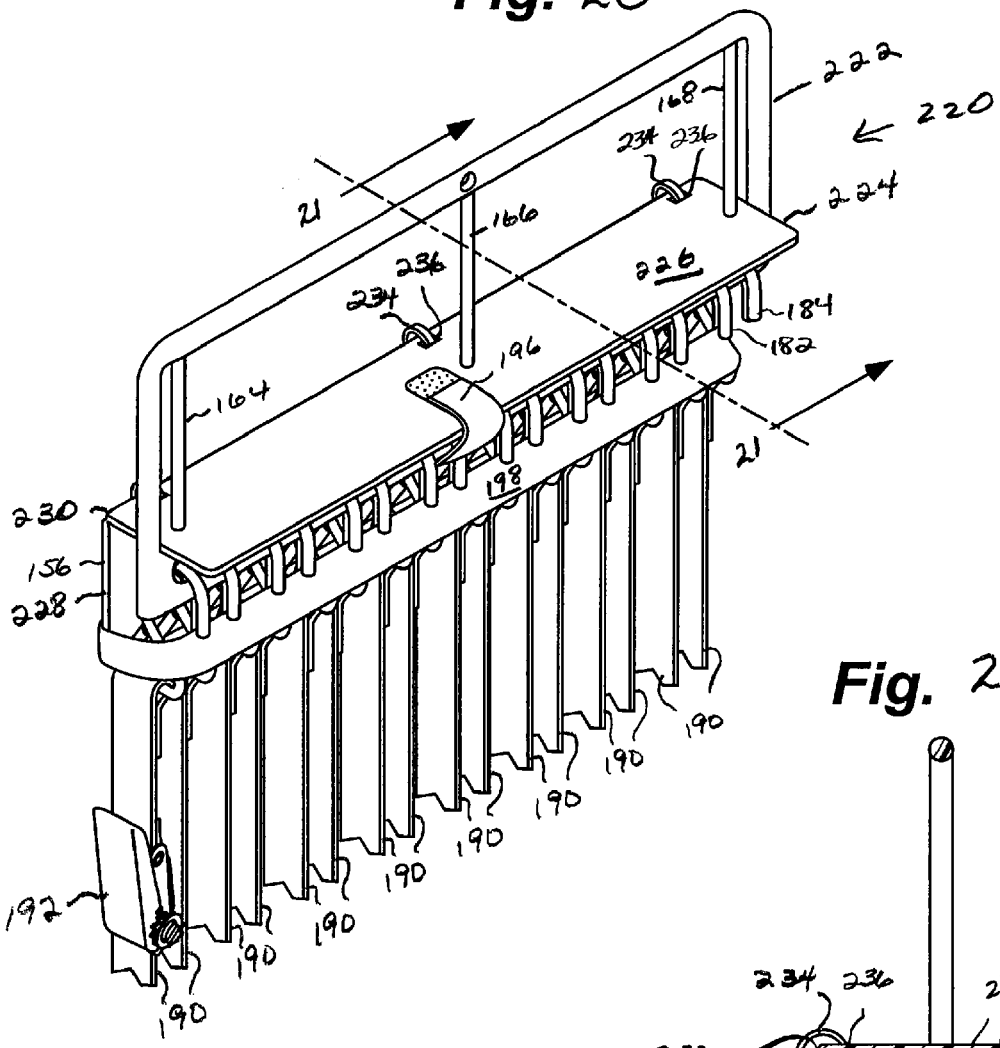
FIG. 20 is a perspective view of yet another embodiment of the hanger of this invention a permanently attached, hinged L-piece.
Figure 21:
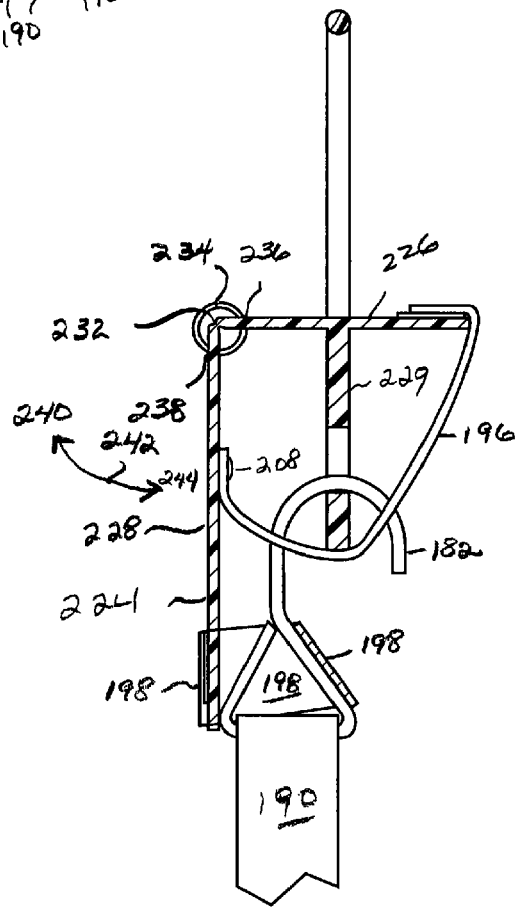
FIG. 21 is a cross sectional view of the hanger of FIG. 20 along line 21-21.

FIGS. 20 and 21 depict yet another embodiment of the storage system of this invention at 220, including a handle 222 and an L-piece 224. The L-piece 224, in turn, includes a horizontal element 226 and vertical elements 228, 229, the horizontal and vertical elements 226, 228 joined at a hinge 230. The hinge 230 may be either or both of a living hinge 232 or a hinge formed by a plurality of rings 234 extending through openings 236, 238 present in respective horizontal and vertical elements 226, 228. In the embodiment depicted, the living hinge 232 is a portion of the L-piece which has a pinched or narrowed thickness to impart flexibility and bending. Alternatively, any other structure imparting the requisite pivoting movement of the vertical element may be used as well. In contrast to the embodiment depicted in FIGS. 16-19, the handle 222 does not include a slot 176. Rather, the L-piece 224 is permanently attached to the handle 222. Exemplary permanent attachment in this context is bonding of the vertical element 229 to the handle lower portion 156 and further bonding the vertical members 164, 166, 168 to the horizontal element 226, for example by welding, gluing, or crimping. The person of ordinary skill only art will, however, readily recognize other means of permanently bonding the L-piece 224 to the handle 222. The hooks 182, 184 of a tie down strap 190 are placed in one of the slots 178 when the vertical element 228 is pivoted upwardly in the direction indicated at 240 of arrow 242. The hooks 182, 184 may then be further secured by pivoting the vertical element 228 downwardly in the direction indicated at 244 of arrow 242. Using the straps 196, 198, the hooks 182, 184 may be further secured as described above.

Figure 22:
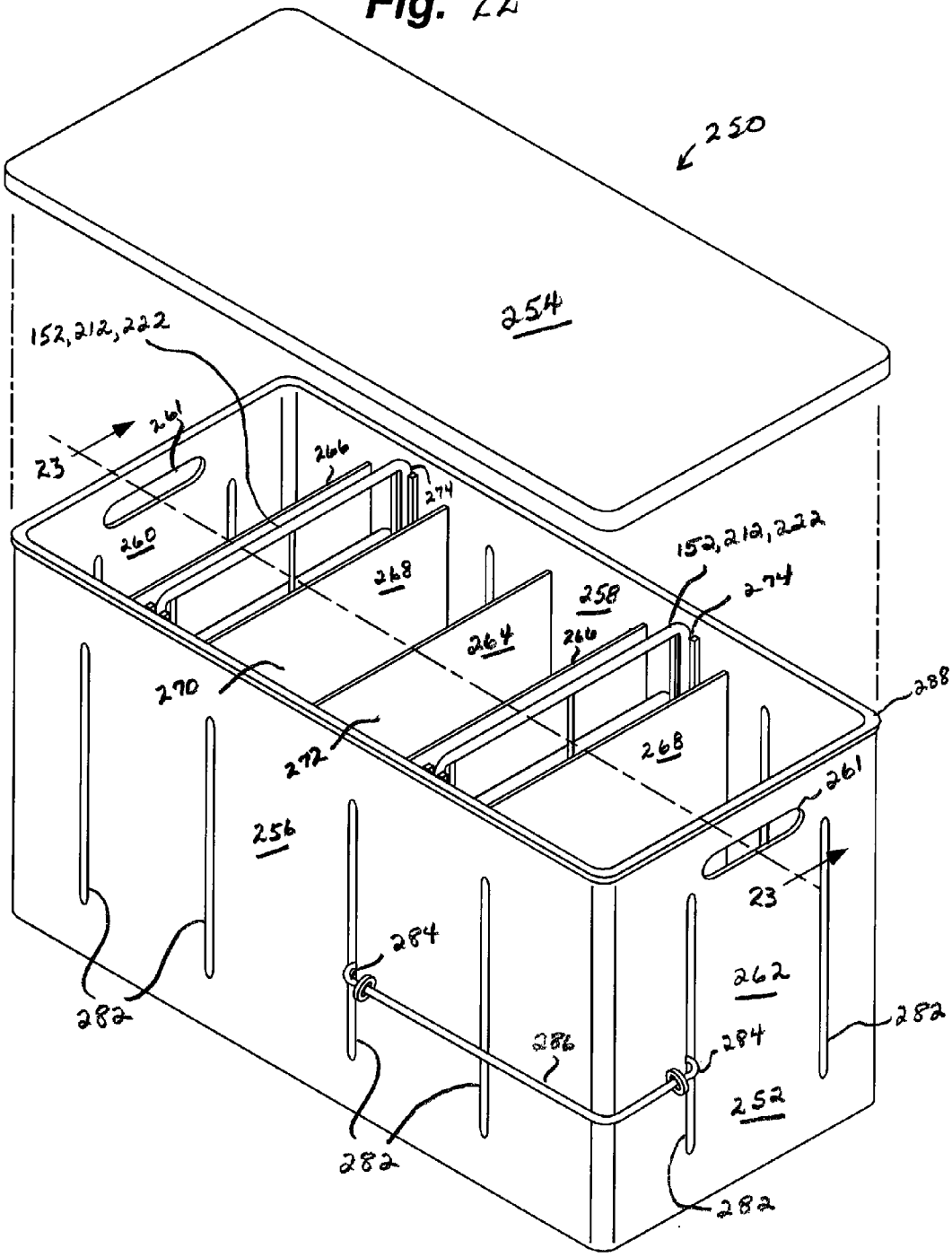
FIG. 22 is a perspective view of a receptacle of this invention for housing and storing hangers of this invention.
Figure 23:
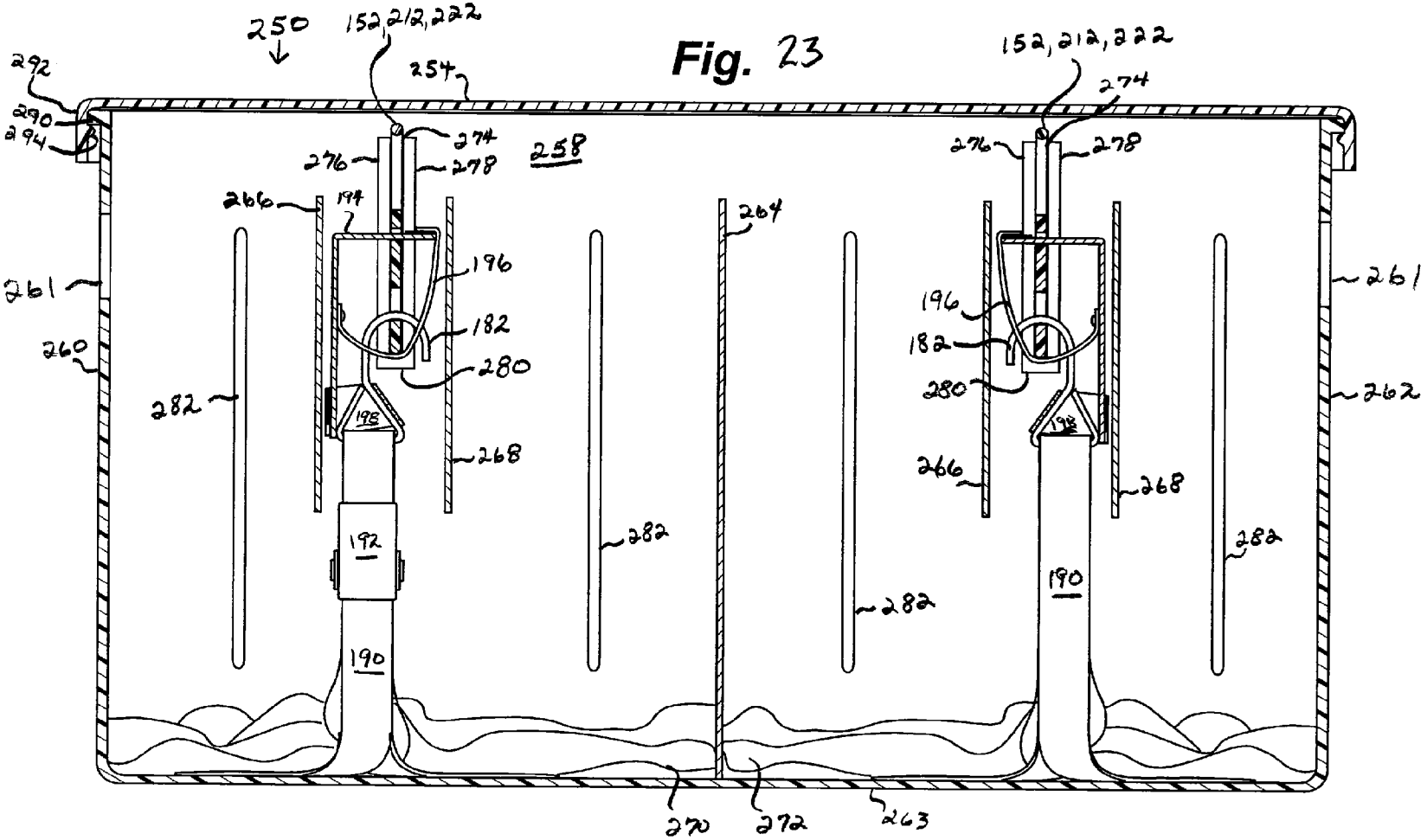
FIG. 23 is a cross sectional view of the receptacle of FIG. 22 viewed along line 23-23.

One embodiment of a system advantageously used with the handles 152, 212, 222 of this invention is shown in FIGS. 22-23 at 250 and includes a receptacle 252 and a lid 254. The container 252 has side walls 256, 258, end walls 260, 262, a bottom wall 263 and an optional center wall 264. Optional handles 261 are formed in the end walls 260, 262. The center wall 264 may divide the receptacle 252 into two equal portions 270, 272 in this embodiment. However, in other embodiments the center wall 264 is absent and there is a single portion accommodating one or a plurality of hangers of this invention. If present, the center wall 264 helps to avoid entanglement when more than, for example, about eight tie down straps are being stored in a container of this invention. Each portion 270, 272, at each side wall 256, 258, has a pair of slots 274 horizontally defined by vertical elements 276, 278 and vertically defined by horizontal element 280, each slot 274 opening at the top to admit the handles 152, 212, or 222. The person of ordinary skill in the art, however, would recognize that the slots 274 could be formed in the side walls 256, 258 in another manner, such as by routing. Optionally present on the side walls 256, 258 and end walls 260, 262 are two or more vertical slots 282. The vertical slots 282 accommodate hooks 284 of elastic cords 286 for storage. FIG. 23 depicts a cross section of the receptacle 252 of FIG. 22, wherein the handles 152, 212, or 222 are stored therein, the hooks 182, 184 secured by L-piece 194 and straps 196, 198, it being understood that the L-piece 224 could be used in lieu of the L-piece 194.

Figure 24:
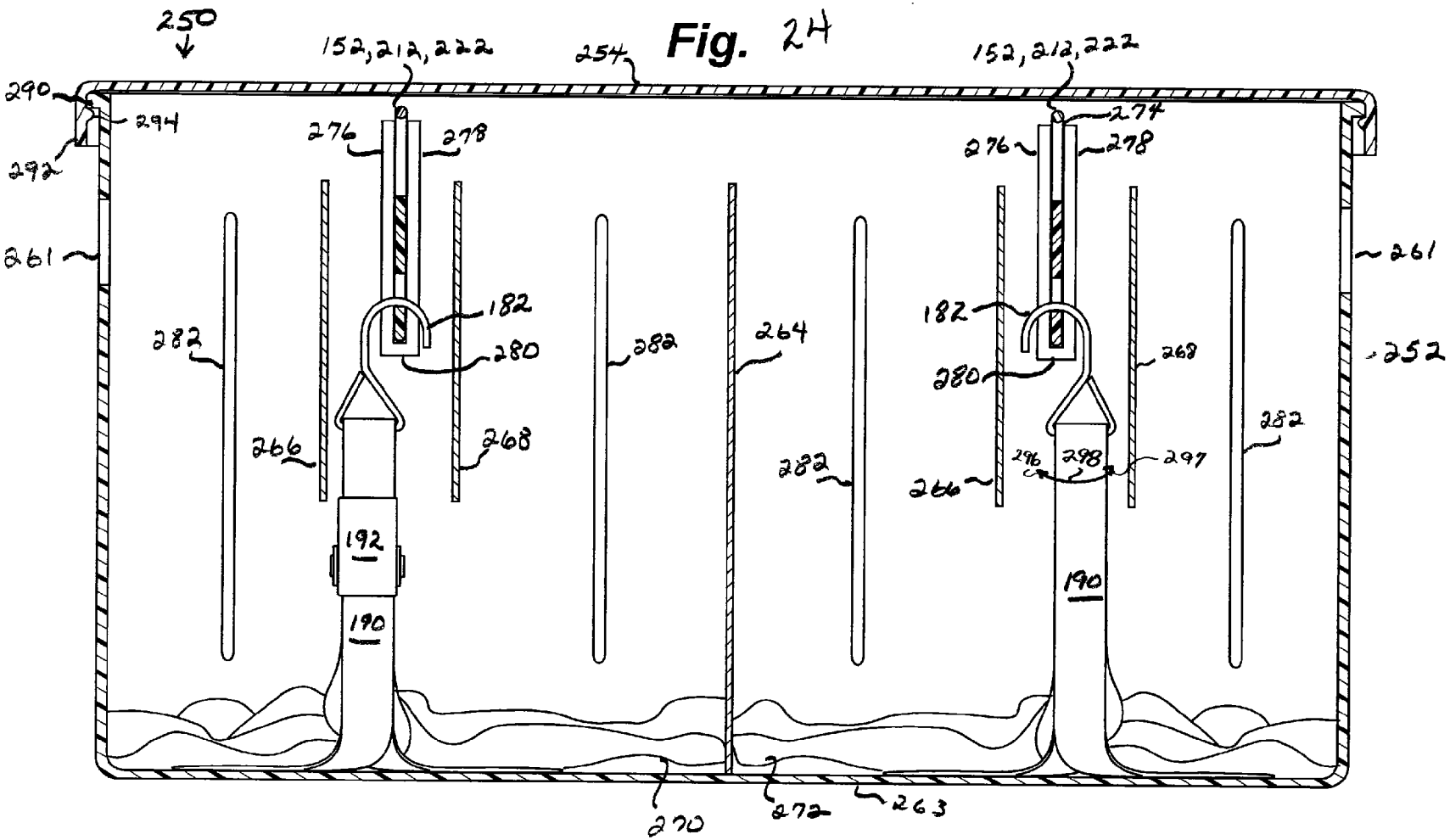
FIG. 24 is a cross sectional view of the receptacle of FIG. 22 viewed along line 23-23 and showing an alternative method of storing the hangers of this invention therein.

Referring to FIG. 24, the hangers 152, 212, or 222 are further secured within the container by the lid 254, which either contacts or is closely proximate to the hangers 152, 212, or 222 to thereby limit vertical movement of the stored hooks. The lid 254, when secured to the receptacle 252, limits upward movement of these hangers, thereby ensuring that the hangers are not displaced from the slots if the container 250 is inverted or jarred. FIG. 24 also illustrates that the hooks 182, 184 may be secured between the half walls 266, 268 without using the L-pieces 194 or 224. Accordingly, the hooks 182, 184 are horizontally retained between the half walls 266, 268 sufficiently, such that the L-pieces 194 or 224 need not be used and such that tie down straps can be secured without expending the time necessary to secure the L-pieces 194 or 224 as described above. The side walls 256, 258 and end walls 260, 262 form a curved periphery 288 having a lip 290 (FIG. 22). The lid 254 terminates in a depending rim 292 with an inner extension 294. As can be seen in FIGS. 23 and 24, the lid 254 can be secured to the receptacle 252 by pressing the rim 292 down until the extension 294 is displaced below the lip 290. As shown in FIG. 24, but also applying to FIGS. 22, 23, the tie down straps 190 may swing or sway generally horizontally when stored in the receptacle 252 as illustrated by directions 296, 297 of arrow 298. In each of the horizontal directions 296, 297, the tie down straps 190 encounter the half walls 266, 268, which thusly limit the magnitude of horizontal motion and act to further secure the tie down straps 190 within the receptacle 252 by preventing the hooks from becoming displaced from within the apertures or slots of the hangers of this invention due to a swinging motion.

Figure 25:
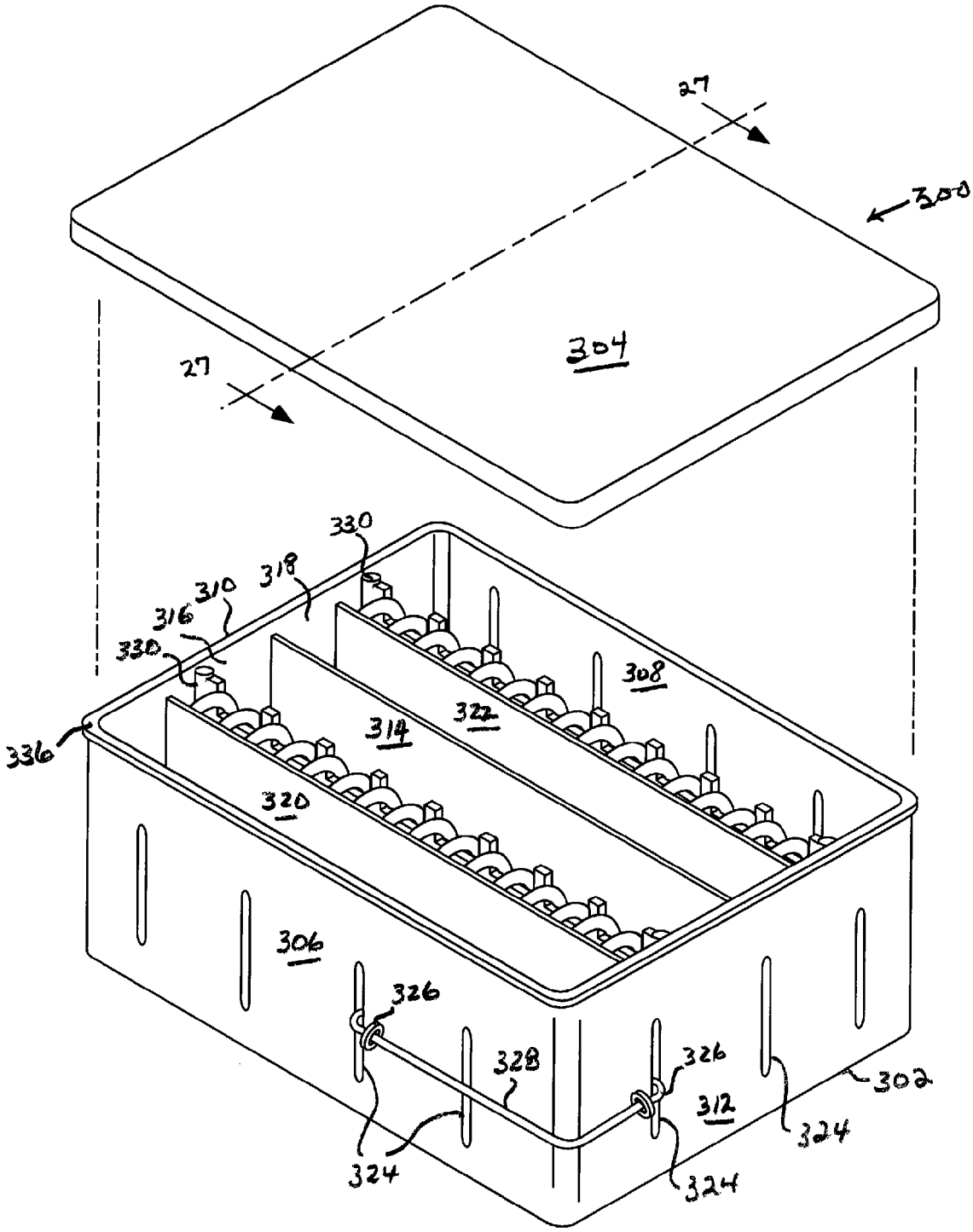
FIG. 25 is a perspective view of another embodiment of a receptacle of this invention for housing and storing hangers of this invention.
Figure 26:
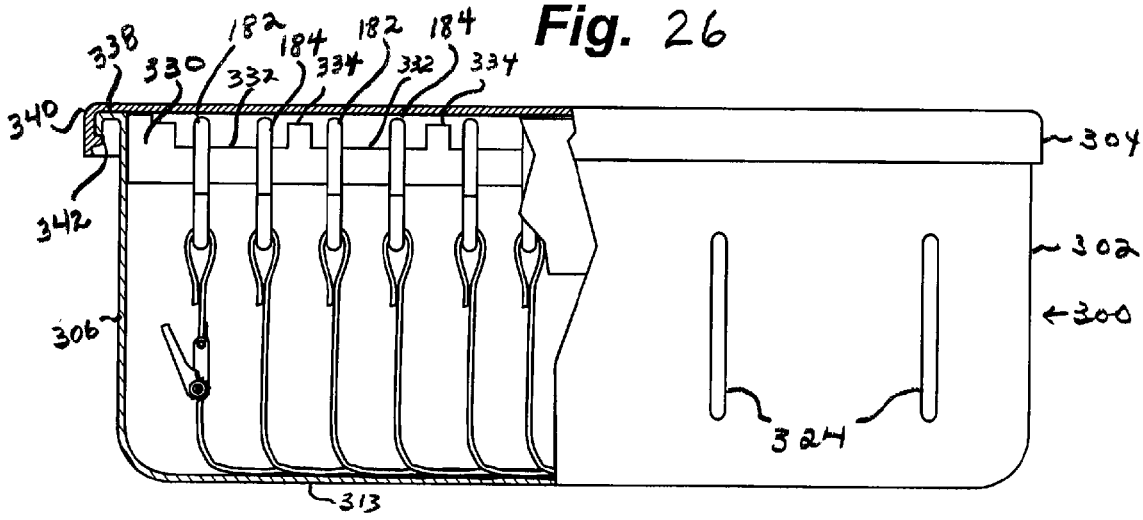
FIG. 26 is a side view of the receptacle of FIG. 25, showing a partial cross section thereof.
Figure 27:
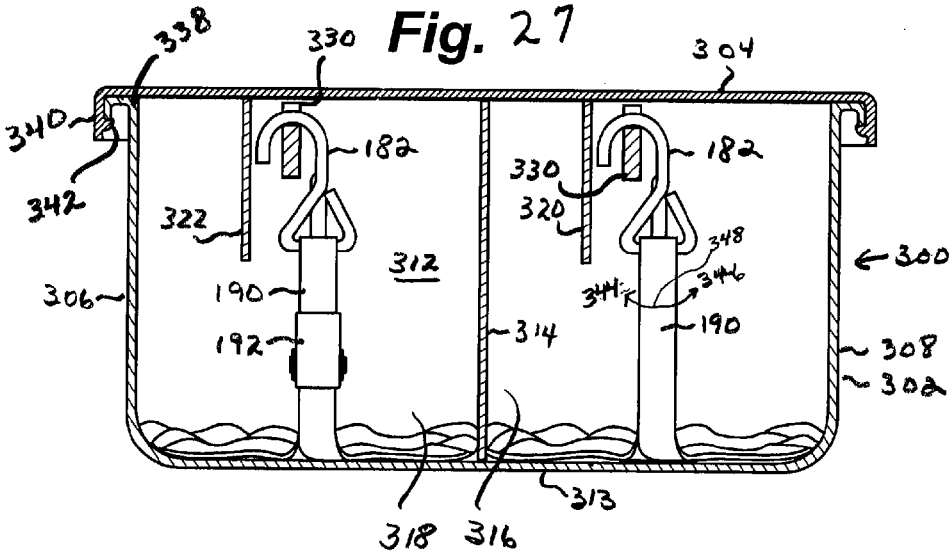
FIG. 27 is a cross sectional view of the receptacle of FIG. 25 along line 27-27.

FIGS. 25-27 depict another system of the invention at 300 and including a receptacle 302 and a lid 304. The receptacle 302 has side walls 306, 308, end walls 310, 312, a bottom wall 313, and a center wall 314. The center wall 314 divides the receptacle 302 into two generally equal portions 316, 318 in this embodiment. Within the portions half walls 320, 322 extend between the end walls 310, 312. Optionally present in the side walls 306, 308 and in the end walls 310, 312 is a plurality of vertical slots 324. Each of the vertical slots 324 may accommodate a hook 326 of an elastic strap 328. Present within each portion 316, 318 is a hook bracket 330. Each a bracket 330 includes a plurality of cutouts (slots or apertures) 332 defined between partitions 334. In the embodiment depicted, the brackets 330 are permanently attached to the end walls 310, 312. However, a person of ordinary skill in the art would readily recognize that the brackets 330 could be accommodated non-permanently, for example by forming the slots 274, as described above in the context of FIGS. 22-24. In this embodiment, the L-pieces of this invention may not be necessary to secure the hooks in place. However, utilization of these L-pieces as described above is fully within the spirit and scope of this invention. The side walls 306, 308 and end walls 310, 312 form a curved periphery 336 terminating in an L-shaped lip 338. The lid 304 has a peripheral rim 340 with an inner extension 342. To secure the lid 304 onto the receptacle 302, the peripheral rim 340 is pressed downwardly until the extension 342 is displaced to a position below the lip 338. As can be seen in FIGS. 26 and 27 the lip 338 forms a handle which can be grasped whether or not the lid 304 is secured onto the receptacle 302. As shown in FIG. 27 but applying as well to FIGS. 25, 26, the tie down straps 190 are subject to generally horizontal motions such as swinging in the directions 344, 346 of arrow 348 when stored in the receptacle 302 as described above. If allowed to sway unrestrained in the direction 344 the hooks 182 could become dislodged from the slot 332; however, swaying or generally horizontal displacement of the tie down straps 190 encounter the half wall 320 (or 322) and consequently any horizontal motions or swaying are thusly limited to thereby secure the hooks 182 in the slot 332.

Suitable materials for manufacturing the receptacles, lids, hangers, L-pieces, straps, and brackets of this invention include synthetic resins such as polyethylene or polypropylene with requisite degrees of stiffness and/or flexibility. However, a person of ordinary skill in the art would readily recognize other suitable resins, such as disclosed, for example, in the Handbook of Plastics, Elastomers, and Composites, Third Edition, Charles A. Harper, Editor in Chief, McGraw-Hill, New York (1996) hereby incorporated by reference. Other suitable materials may include metals such as aluminum or steel or wood. Additionally, leather, fabric, or natural or synthetic rubber may be utilized in forming the straps of this invention.

In many of the embodiments of this invention, both hooks of a tie down strap are stored and transported by being secured in an aperture or slot. The pair of hooks in such aperture of slot is secured therein by limiting the upward movement of the hook ends such that the hooks are not displaced from the aperture or slot by being jarred. The instant L-piece or lids of this invention further secures the hooks in place when the hooks are disposed in the apertures of slots of the receptacles or hangers of this invention. The instant L-piece secures the hooks to the hangers of this invention by preventing horizontal and vertical movement of the hooks, thereby limiting vertical movement of the hook tips. The lids, when secured to the receptacles of this invention, also secure the hangers by ensuring that the hangers are not displaced from slots present in the receptacles or secure the hooks by limiting their vertical movement.

By disposing both hooks of a tie down strap in an aperture or slot in a receptacle, bracket, or hanger of this invention, the tie down strap is securely stored, yet can be easily removed from the receptacle by grasping and removing both hooks from the aperture or slot, then optionally shaking the hooks and tie down strap to free it from other tie down straps being stored. Such apertures or slots may be dimensioned to accommodate any hook desired to be stored and transported. Tangles and snags with other stored tie down straps are either eliminated or significantly reduced in incidence. Straps of any commonly available length, for example, from four feet to 26 feet, may be stored, then removed by the containers of this invention.

Because numerous modifications of this invention may be made without departing from the spirit thereof, the scope of the invention is not to be limited to the embodiments illustrated and described. Rather, the scope of the invention is to be determined by the appended claims and their equivalents.

What is claimed is:

1. A system for storing tie down straps by vertically and horizontally securing a hook of each end of a tie-down strap, comprising a hanger, said hanger comprising:

a handle; and a lower portion depending from the handle and defining one or more apertures, each of said one or more apertures dimensioned and positioned for accommodating at least a pair of hooks of a tie down strap; and an L-piece including a horizontal element joined to a vertical element, the horizontal element coupled to the lower portion above the apertures and transverse to a plane formed by the lower portion defining the one or more apertures, the vertical element extending downwardly and away from the horizontal element such that the vertical element is parallel the plane formed by the lower portion defining the one or more apertures and opposite the apertures of the lower portion.

2. The system of claim 1, wherein said handle includes a generally central positioned handle aperture.

3. The system of claim 1, wherein said handle includes a pair of openings, said pair of openings positioned for hanging said handle.

4. The system of claim 3, wherein said pair of openings is about 16 inches apart on center.

5. The system of claim 1, further comprising a first strap and a second strap, said first and second straps attaching said L-piece to said handle and said lower portion.

6. The system of claim 5, said lower portion having a longitudinal slot; and said longitudinal slot accommodating said horizontal element, said first strap attached to said vertical element and reversibly attachable to said horizontal element.

7. The system of claim 6, wherein said second strap is attachable to said vertical element.

8. The system of claim 5, wherein said L-piece is permanently joined to said handle, said vertical element pivoting relative to said horizontal element at a hinge.

9. The system of claim 1, wherein said apertures are generally oval-shaped.

10. The system of claim 1, wherein said apertures are generally rectangular-shaped.

* * * * *

UNITED STATES PATENT AND TRADEMARK OFFICE

CERTIFICATE OF CORRECTION

PATENT NO. : 8,074,795 B2
APPLICATION NO. : 12/351411
DATED : December 13, 2011
INVENTOR(S) : Neu et al.

It is certified that error appears in the above-identified patent and that said Letters Patent is hereby corrected as shown below:

Title page, item (76) Inventors: delete "Tammy" and insert --Tammie--

Signed and Sealed this
Ninth Day of October, 2012

David J. Kappos

David J. Kappos
*Director of the United States Patent and Trademark Office*